US010556441B2

(12) United States Patent
Ueda et al.

(10) Patent No.: US 10,556,441 B2
(45) Date of Patent: Feb. 11, 2020

(54) LIQUID DISCHARGE DEVICE

(71) Applicant: BROTHER KOGYO KABUSHIKI KAISHA, Nagoya-shi, Aichi-ken (JP)

(72) Inventors: Toshiro Ueda, Inazawa (JP); Mikio Ogawa, Nagoya (JP); Kenta Horade, Toukai (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/156,048

(22) Filed: Oct. 10, 2018

(65) Prior Publication Data

US 2019/0105910 A1 Apr. 11, 2019

(30) Foreign Application Priority Data

Oct. 10, 2017 (JP) ..... 2017-197177

(51) Int. Cl.
*B41J 2/175* (2006.01)

(52) U.S. Cl.
CPC ..... *B41J 2/17566* (2013.01); *B41J 2/17523* (2013.01); *B41J 2/17546* (2013.01)

(58) Field of Classification Search
CPC . B41J 2/17566; B41J 2/17523; B41J 2/17546
See application file for complete search history.

(56) References Cited

U.S. PATENT DOCUMENTS

2008/0204488 A1* 8/2008 Usui ..... B41J 2/17513 347/7
2009/0290002 A1* 11/2009 Katoh ..... B41J 2/175 347/85
2013/0194361 A1* 8/2013 Takahashi ..... B41J 2/19 347/92

FOREIGN PATENT DOCUMENTS

JP 2000-190523 A 7/2000
JP 2008-213162 A 9/2008

* cited by examiner

*Primary Examiner* — Jason S Uhlenhake
(74) *Attorney, Agent, or Firm* — Merchant & Gould P.C.

(57) ABSTRACT

The liquid discharge device performs a series of process including: controlling a head to discharge ink in response to receiving discharge instruction; calculating a waiting time Tw based on ink discharge amount Dh after completing the discharge of the ink; executes counting process based on a signal received from a liquid level sensor after elapse of the waiting time T2 from the completion of discharging the ink from the head.

11 Claims, 12 Drawing Sheets

LIQUID DISCHARGE DEVICE

CROSS-REFERENCE TO RELATED APPLICATION

This application claims priorities from Japanese Patent Application No. 2017-197177 filed on Oct. 10, 2017, the entire subject matters of which is incorporated herein by reference.

TECHNICAL FIELD

The present disclosure relates to a liquid discharge device for discharging a liquid.

BACKGROUND

From the related art, an inkjet printer is known (for example, JP-A-2008-213162) which includes a detachable main tank, a sub tank that stores ink supplied from the mounted main tank, and an image recording unit that discharges the ink stored in the sub tank and records an image. Internal spaces of the main tank and the sub tank are opened to the air. For this reason, when the main tank is installed in the inkjet printer, the ink moves so that the liquid level of the main tank and the liquid level of the sub tank are aligned with the same height by the difference between a water head in the internal space of the main tank and a water head in the internal space of the sub tank (hereinafter, referred to as "water head difference"). Thus, when the water head difference becomes almost zero (hereinafter, referred to as "equilibrium state"), the ink movement is stopped.

For example, when the main tank or the sub tank includes a sensor that detects the liquid level, the liquid level of ink in the main tank or the sub tank falls down the detection position, and the user can be notified that the residual amount of ink is low. Further, when the liquid level of ink in the main tank or the sub tank reaches the detection position, counting of the amount of ink discharged from the head is started, and the residual amount of ink in the main tank or the sub tank can be corrected. However, if the liquid level of the ink ascends in an equilibrium state and becomes higher than the detection position after the sensor detects that the liquid level of the ink is lower than the detection position in a state where a water head difference occurs, the detection of the sensor changes. Therefore, the determination result varies depending on the timing at which the sensor signal is determined. On the other hand, since the time until the equilibrium state from when the water head difference occurs varies depending on the amount of ink discharged from the image recording unit, for example, if in a case of determining uniformly the signal of the sensor after a predetermined time has elapsed after the image recording is completed by the image recording unit, the time required for detecting the liquid level of the ink and correcting the residual amount of ink becomes uniformly longer.

SUMMARY

The present disclosure has been made in view of the above circumstances, and one of objects of the present disclosure is to provide a liquid discharge device capable of accurately determining a signal output from a liquid level sensor for detecting a liquid level of a liquid in a first liquid chamber or a second liquid chamber.

According to an illustrative embodiment of the present disclosure, there is provided a liquid discharge device including: a main tank including: a first liquid chamber storing a liquid; and a first flow path, one end of the first flow path communicated with the first liquid chamber, the other end of the first flow path communicated with an atmosphere; a sub tank comprising a second liquid chamber; a second flow path through which the first liquid chamber and the second liquid chamber communicate with each other; a third flow path, one end of the third flow path being located below the second flow path communicated with the second liquid chamber; a head communicated with the other end of the third flow path; a liquid level sensor; and a controller. The controller is configured to: receive a discharge instruction for discharging a liquid through the head; control the head based on the discharge instruction to discharge the liquid from the head; determine a waiting time based on information on the discharge of the liquid after the discharge of the liquid through the head is completed; and determine a signal received from the liquid level sensor when the waiting time elapses from a time point at which the discharge of the liquid through the head is completed.

DETAILED DESCRIPTION

Figure 1A:
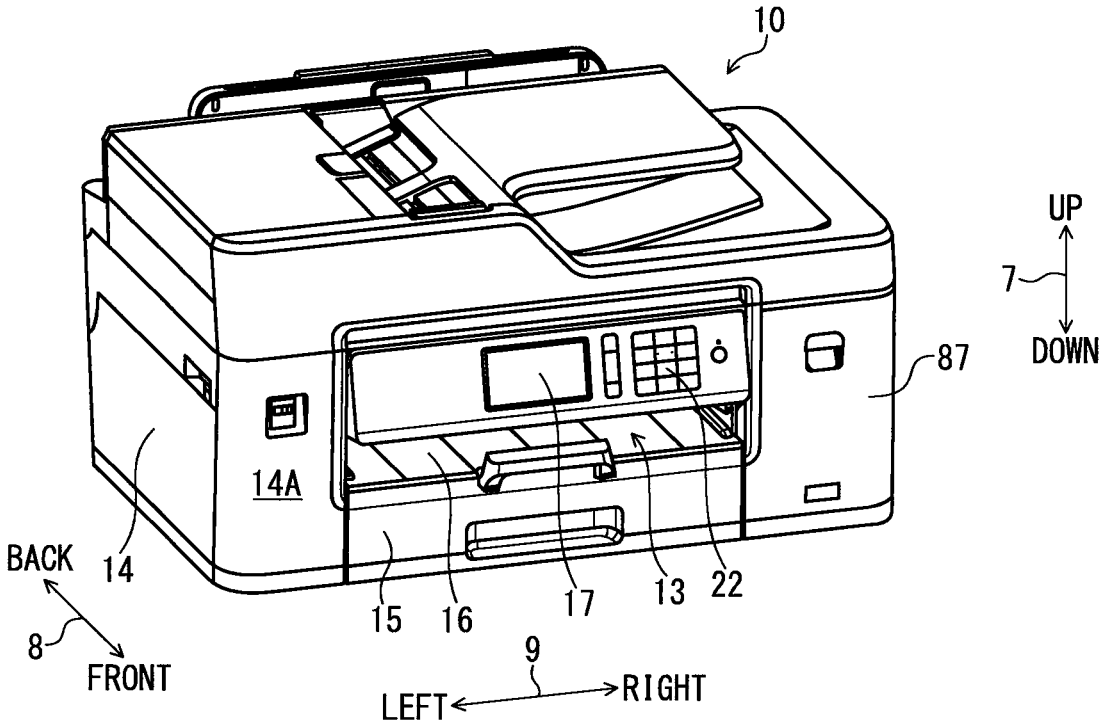
FIG. 1A is an external perspective view of a printer and illustrates a state where a cover is in a covering position.

An embodiment of the invention will be described below. It is noted that the embodiment described below is merely an example and can be appropriately modified. In addition, an up and down direction 7 is defined with reference to a posture of a printer 10 installed in a horizontal plane in a usable manner, a front and back direction 8 is defined with a surface on which an opening 13 of the printer 10 is formed as a front surface, and a left and right direction 9 is defined when viewing the printer 10 from the front surface. In the embodiment, the up and down direction 7 in the use posture corresponds to a vertical direction, and the front and back direction 8 and the left and right direction 9 correspond to a horizontal direction. The front and back direction 8 and the left and right direction 9 are orthogonal to each other.

[Outline of Printer 10]

The printer 10 according to the embodiment is an example of a liquid discharge device that records an image on a sheet using an inkjet recording method. The printer 10 has a housing 14 having substantially rectangular parallelepiped shape. Further, the printer 10 may be a so-called "multi-function peripheral" having a facsimile function, a scan function, and a copy function.

Figure 1B:
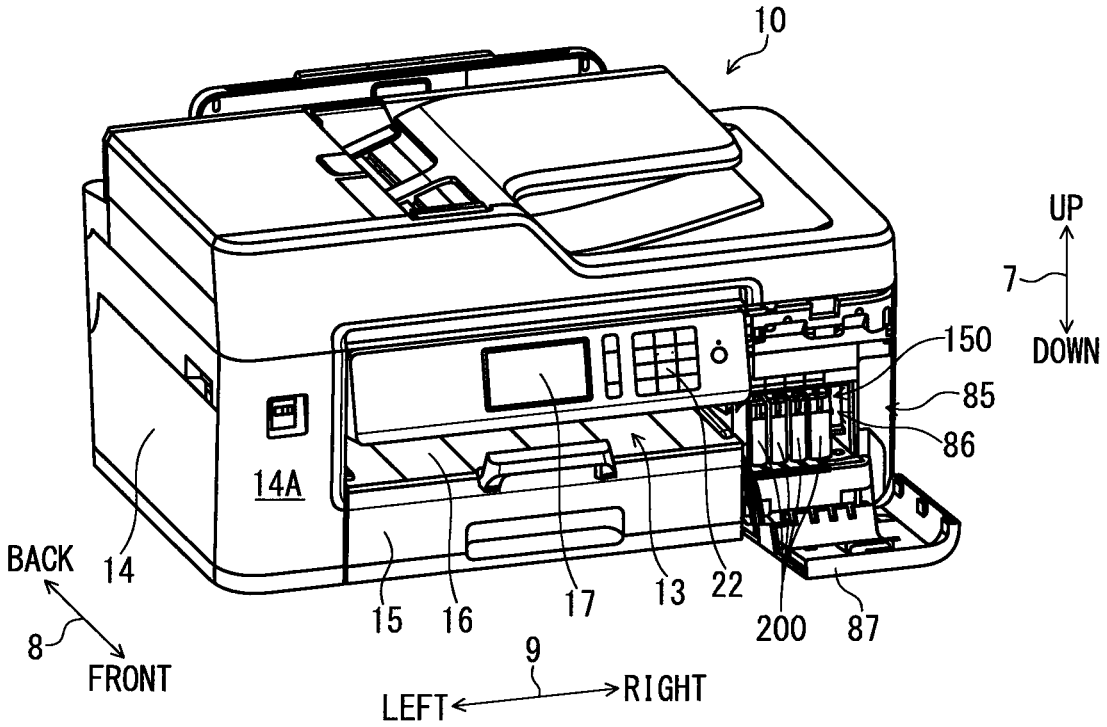
FIG. 1B is an external perspective view of the printer and illustrates a state where the cover is in an exposing position.
Figure 2:
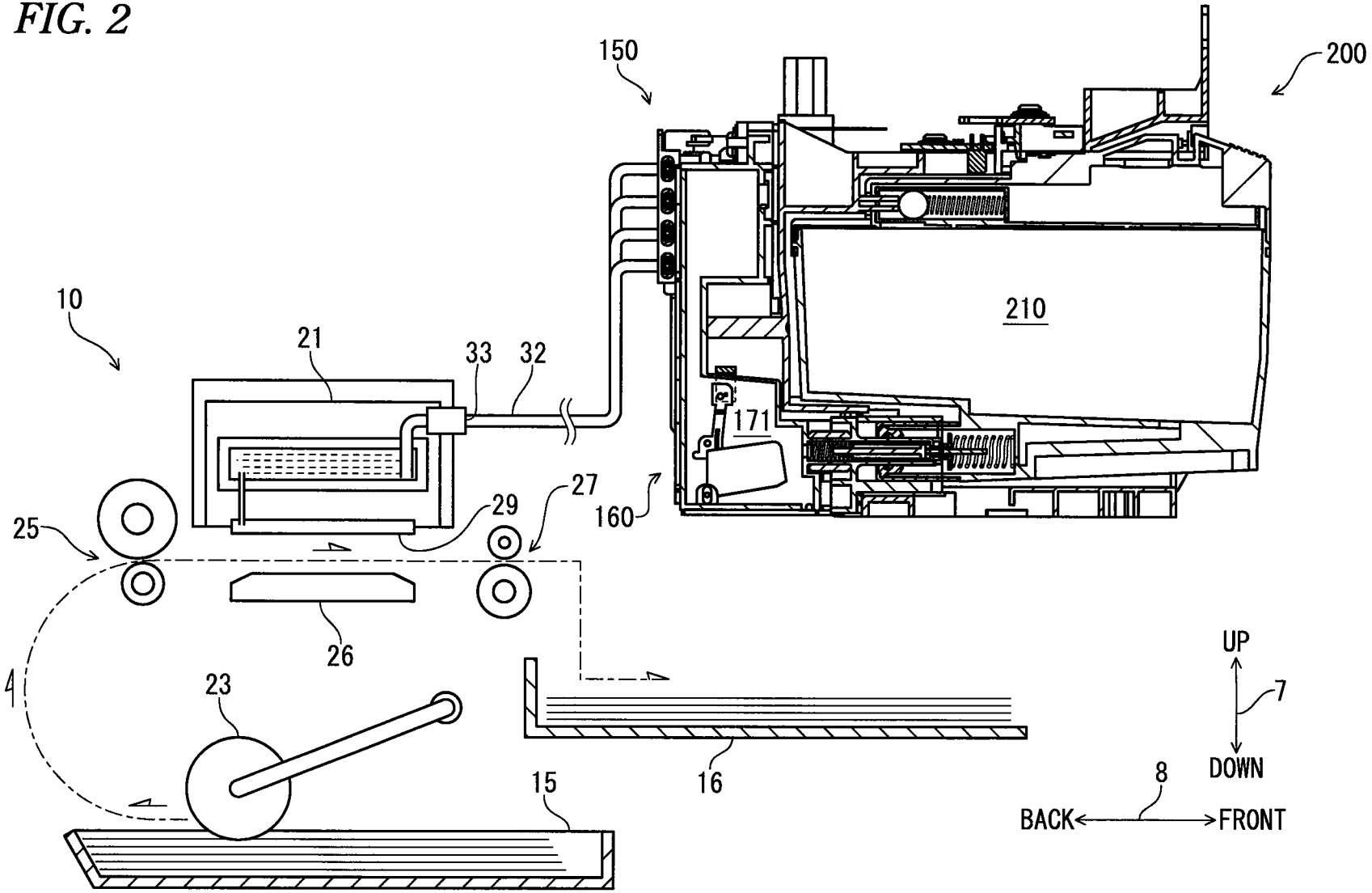
FIG. 2 is a schematic sectional view schematically illustrating an internal structure of the printer.

As illustrated in FIGS. 1A, 1B, and 2, the housing 14 includes therein a feed tray 15, a feed roller 23, a conveyance roller 25, a head 21 including a plurality of nozzles 29, a platen 26 facing the head 21, a discharge roller 27, a discharge tray 16, an installation case 150 to which a cartridge 200 is detachably attached, and a tube 32 for communicating the head 21 with the cartridge 200 installed in the installation case 150.

The printer 10 drives the feed roller 23 and the conveyance roller 25 to convey a sheet supported by the feed tray 15 to the position of the platen 26. Next, the printer 10 discharges an ink, which is supplied from the cartridge 200 installed in the installation case 150 through the tube 32, to the head 21 through the nozzle 29. Thus, the ink is landed on the sheet supported by the platen 26, and an image is recorded on the sheet. Then, the printer 10 drives the discharge roller 27 to discharge the sheet, on which the image is recorded, to the discharge tray 16.

More specifically, the head 21 may be installed in a carriage that reciprocates in a main scanning direction intersecting with the sheet conveyance direction of the sheet by the conveyance roller 25. Then, the printer 10 may cause the head 21 to discharge ink through the nozzle 29 in the course of moving the carriage from one side to the other side in the main scanning direction. Thus, an image is recorded on a partial area of the sheet (hereinafter, referred to as "one pass") facing the head 21. Next, the printer 10 may cause the conveyance roller 25 to convey the sheet so that a next image recording area of the sheet faces the head 21. Then, these processes are alternately and repeatedly executed, and thus an image is recorded on one sheet.

In the embodiment, the discharge of ink from the nozzle 29 of the head 21 in the image recording is referred to as "jetting", while the discharge of ink from the nozzle 29 of the head 21 in the purging is referred to as "jetting", but the "jetting" is conceptually included in the "discharge".

[Cover 87]

As illustrated in FIGS. 1A and 1B, an opening 85 is formed at a right end in the left and right direction 9 on a front surface 14A of the housing 14. The housing 14 further includes a cover 87. The cover 87 is rotatable between a covering position (a position illustrated in FIG. 1A) at which the opening 85 is covered and an exposing position (a position illustrated in FIG. 1B) at which the opening 85 is exposed. The cover 87 is supported by the housing 14 so as to be rotatable around a rotation axis along the left and right direction 9 in the vicinity of a lower end of the housing in the up and down direction 7, for example. Then, the installation case 150 is located in an accommodating space 86 which is provided inside the housing 14 and spreads backwards from the opening 85.

[Cover Sensor 88]

Figure 6:
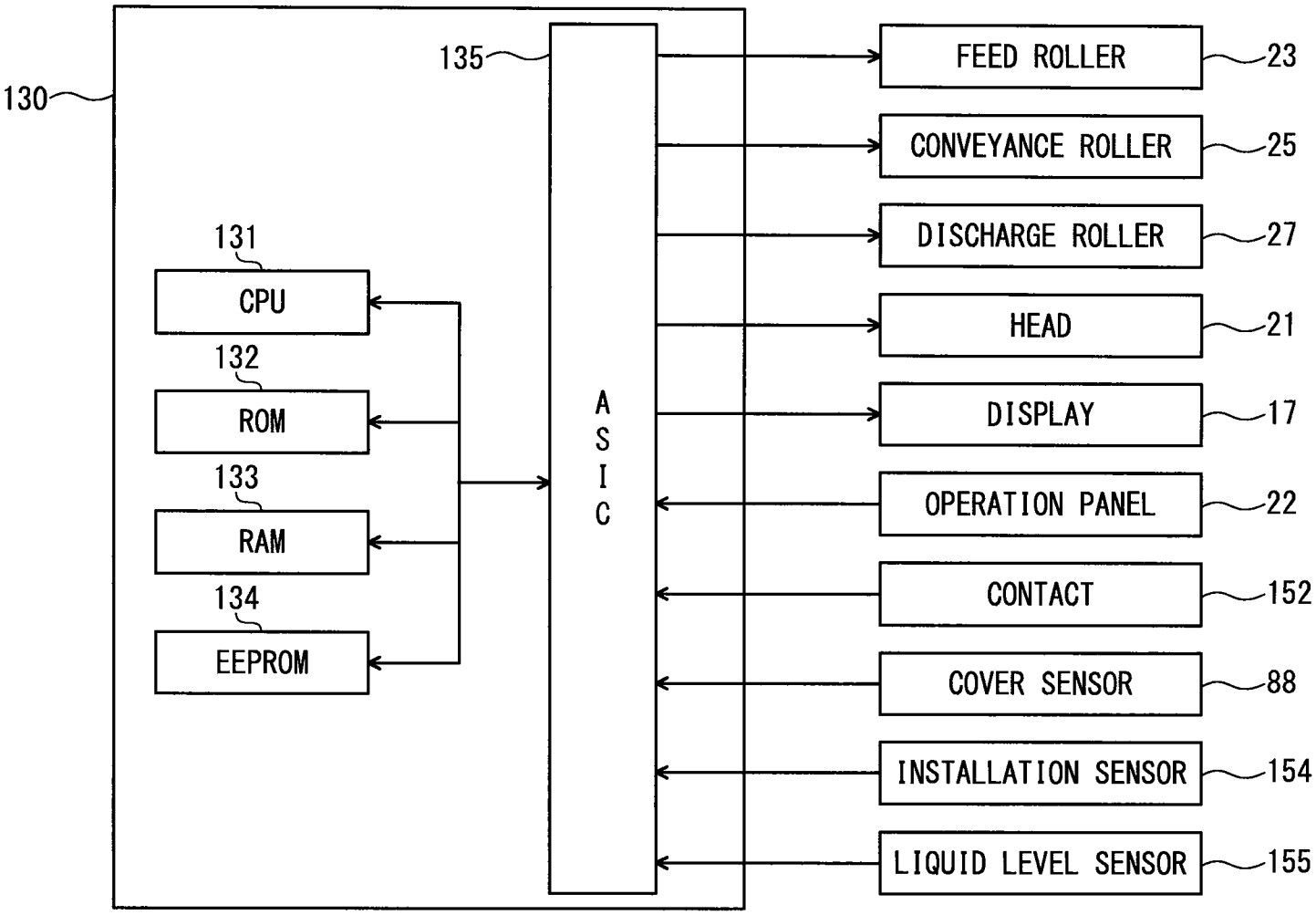
FIG. 6 is a block diagram of the printer.

The printer 10 includes a cover sensor 88 (see FIG. 6). The cover sensor 88 may be, for example, a mechanical sensor such as a switch with and from which the cover 87 contacts and separates, or an optical sensor in which light is blocked or transmitted depending on the position of the cover 87. The cover sensor 88 outputs a signal corresponding to the position of the cover 87 to a controller 130. More specifically, the cover sensor 88 output a low-level signal to the controller 130 when the cover 87 is located at the covering position. On the other hand, the cover sensor 88 outputs a high-level signal having higher signal intensity than the low-level signal to the controller 130 when the cover 87 is located at a position different from the covering position. In other words, the cover sensor 88 outputs the high-level signal to the controller 130 when the cover 87 is located at the exposing position.

[Installation Case 150]

Figure 3:
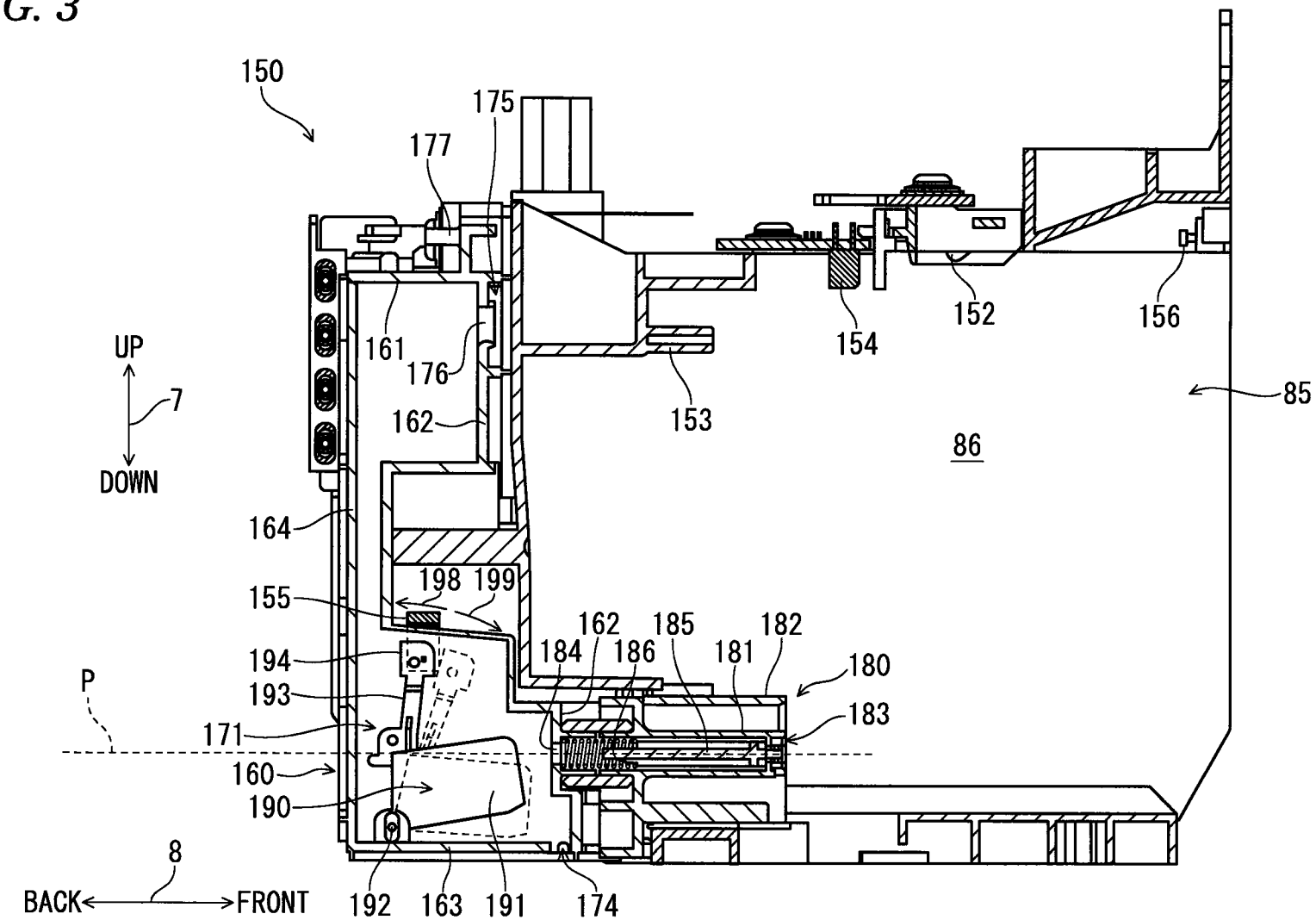
FIG. 3 is a longitudinal sectional view of an installation case.

As illustrated in FIG. 3, the installation case 150 includes a contact 152, a rod 153, an installation sensor 154, a liquid level sensor 155, and a lock pin 156. The installation case 150 can accommodate four cartridges 200 corresponding to respective colors of black, cyan, magenta, and yellow. That is, the installation case 150 includes four contacts 152, four rods 153, four installation sensors 154, and four liquid level sensors 155 corresponding to four cartridges 200. Four cartridges 200 are installed in the installation case 150, but one cartridge or five or more cartridges may be mounted. The contact 152 is an example of an interface.

The installation case 150 has a box shape having an internal space in which the cartridge 200 is accommodated. The internal space of the installation case 150 is defined by a top wall defining an upper end top wall, a bottom wall defining a lower end, an inner wall defining a rear end in the front and back direction 8, and a pair of sidewalls defining both ends in the left and right direction 9. On the other hand, the opening 85 is located to face the inner wall of the installation case 150. That is, the opening 85 exposes the inner space of the installation case 150 to the outside of the printer 10 when the cover 87 is disposed at the exposing position.

Then, the cartridge 200 is inserted into the installation case 150 through the opening 85 of the housing 14, and is pulled out of the installation case 150. More specifically, the cartridge 200 passes backwards through the opening 85 in the front and back direction 8, and is installed in the installation case 150. The cartridge 200 pulled out of the installation case 150 passes forward through the opening 85 in the front and back direction 8.

[Contact 152]

The contact 152 is located on the top wall of the installation case 150. The contact 152 protrudes downwardly toward the internal space of the installation case 150 from the top wall.

The contact 152 is located so as to be in contact with an electrode 248 (to be described below) of the cartridge 200 in a state where the cartridge 200 is installed in the installation case 150. The contact 152 has conductivity and is elastically deformable along the up and down direction 7. The contact 152 is electrically connected to the controller 130.

[Rod 153]

The rod 153 protrudes forward from the inner wall of the installation case 150. The rod 153 is located above a joint 180 (to be described below) on the inner wall of the installation case 150. The rod 153 enters an air valve chamber 214 through an air communication port 221 (to be described below) of the cartridge 200 in the course of installing the cartridge 200 on the installation case 150. When the rod 153 enters the air valve chamber 214, the air valve chamber 214 to be described below communicates with the air.

[Installation Sensor 154]

The installation sensor 154 is located on the top wall of the installation case 150. The installation sensor 154 is a sensor for detecting whether the cartridge 200 is installed in the installation case 150. The installation sensor 154 includes a light emitting portion and a light receiving portion which are separated from each other in the left and right direction 9. In the state where the cartridge 200 is installed in the installation case 150, a light shielding rib 245 (to be described below) of the cartridge 200 is located between the light emitting portion and the light receiving portion of the installation sensor 154. In other words, the light emitting portion and the light receiving portion of the installation sensor 154 are located opposite to each other across the light shielding rib 245 of the cartridge 200 installed in the installation case 150.

The installation sensor 154 outputs a different signal (denoted as "installation signal" in the drawings) depending on whether the light irradiated along the left and right direction 9 from the light emitting portion is received by the light receiving portion. The installation sensor 154 outputs a low-level signal to the controller when an intensity of the light received by the light receiving portion is lower than threshold intensity, for example. Meanwhile, the installation sensor 154 outputs a high-level signal having higher signal intensity than the low-level signal to the controller 130 when the intensity of the light received by the light receiving portion is equal to or higher than the threshold intensity.

[Liquid level Sensor 155]

The liquid level sensor 155 is a sensor for detecting whether a detection target portion 194 of an actuator 190 (to be described below) is located at a detection position. The liquid level sensor 155 includes a light emitting portion and a light receiving portion which are separated from each other in the left and right direction 9. In other words, the light emitting portion and the light receiving portion of the liquid level sensor 155 are located opposite to each other across the detection target portion 194 located at the detection position. The liquid level sensor 155 outputs a different signal (denoted as "liquid level signal" in the drawings) depending on whether the light output from the light emitting portion is received by the light receiving portion. The installation sensor 155 outputs a low-level signal to the controller when an intensity of the light received by the light receiving portion is lower than threshold intensity, for example. Meanwhile, the installation sensor 155 outputs a high-level signal having higher signal intensity than the low-level signal to the controller 130 when the intensity of the light received by the light receiving portion is equal to or higher than the threshold intensity. The high-level signal is an example of a first signal, and the low-level signal is an example of a second signal.

[Lock Pin 156]

The lock pin 156 is a rod-like member extending along the left and right direction 9 at the upper end of the internal space of the installation case 150 and in the vicinity of the opening 85. Both ends of the lock pin 156 in the left and right direction 9 are fixed to the pair of sidewalls of the installation case 150. The lock pin 156 extends in the left and right direction 9 across four spaces in which four cartridges 200 can be accommodated. The lock pin 156 is used to hold the cartridge 200 installed in the installation case 150 at a installation position illustrated in FIG. 5. The cartridge 200 is engaged with the lock pin 156 in a state of being installed in the installation case 150.

[Tank 160]

The printer 10 includes four tanks 160 corresponding to four cartridges 200. The tank 160 is located backwards from the inner wall of the installation case 150. As illustrated in FIG. 3, the tank 160 includes an upper wall 161, a front wall 162, a lower wall 163, a rear wall 164, and a pair of sidewalls (not illustrated). The front wall 162 includes a plurality of walls which deviate from each other in the front and back direction 8. A liquid chamber 171 is formed inside the tank 160. The tank 160 is an example of a sub tank. The liquid chamber 171 is an example of a second liquid chamber.

Among the walls forming the tank 160, at least the wall facing the liquid level sensor 155 has translucency. Thus, the light output from the liquid level sensor 155 can penetrate through the wall facing the liquid level sensor 155. At least a part of the rear wall 164 may be formed of a film welded to the upper wall 161, the lower wall 163, and an end face of the sidewall. In addition, the sidewall of the tank 160 may be common to the installation case 150, or may be independent of the installation case 150. Moreover, the tanks 160 adjacent to each other in the left and right direction 9 are partitioned by a partition wall (not illustrated). Four tanks 160 have substantially the common configuration.

The liquid chamber 171 communicates with an ink flow path (not illustrated) through an outflow port 174. A lower end of the outflow port 174 is defined by the lower wall 163 defining the lower end of the liquid chamber 171. The outflow port 174 is located below the joint 180 (more specifically, a lower end of a through-hole 184) in the up and down direction 7. The ink flow path (not illustrated) communicating with the outflow port 174 communicates with the tube 32 (see FIG. 2). Thus, the liquid chamber 171 communicates with the head 21 from the outflow port 174 through the ink flow path and the tube 32. That is, the ink stored in the liquid chamber 171 is supplied from the outflow port 174 to the head 21 through the ink flow path and the tube 32. Each of the ink flow path and the tube 32 communicating with the outflow port 174 is an example of a third flow path in which one end (outflow port 174) communicates with the liquid chamber 171 and the other end 33 (see FIG. 2) communicates with the head 21.

The liquid chamber 171 communicates with the air through an air communication chamber 175. More specifically, the air communication chamber 175 communicates with the liquid chamber 171 through the through-hole 176 penetrating the front wall 162. In addition, the air communication chamber 175 communicates with the outside of the printer 10 through an air communication port 177 and a tube (not illustrated) connected to the air communication port 177. That is, the air communication chamber 175 is an example of a fourth flow path in which one end (through-hole 176) communicates with the liquid chamber 171 and the other end (air communication port 177) communicates with the outside of the printer 10. The air communication chamber 175 communicates with the air through the air communication port 177 and the tube (not illustrated).

[Joint 180]

As illustrated in FIG. 3, the joint 180 includes a needle 181 and a guide 182. The needle 181 is a tube in which a flow path is formed. The needle 181 protrudes forward from the front wall 162 defining the liquid chamber 171. An opening 183 is formed at a protruding tip of the needle 181. In addition, the internal space of the needle 181 communicates with the liquid chamber 171 through a through-hole 184 penetrating the front wall 162. In the needle 181, one end (opening 183) communicates with the outside of the tank 160 and the other end (through-hole 184) communicates with the liquid chamber 171. The guide 182 is a cylindrical member disposed around the needle 181. The guide 182 protrudes forward from the front wall 162 and has a protruding end which is opened.

In the internal space of the needle 181, a valve 185 and a coil spring 186 are located. In the internal space of the needle 181, the valve 185 is movable between a closed position and an opened position in the front and back direction 8. The valve 185 closes the opening 183 when being positioned at the closed position. Further, the valve 185 opens the opening 183 when being located at the opened position. The coil spring 186 urges forward the valve 185 in a moving direction from the opened position to the closed position, that is, the front and back direction 8.

[Actuator 190]

The actuator 190 is located in the liquid chamber 171. The actuator 190 is supported by a support member (not illustrated) disposed in the liquid chamber 171 so as to be rotatable in directions of arrows 198 and 199. The actuator 190 is rotatable between a position indicated by a solid line in FIG. 3 and a position indicated by a broken line. Further, the actuator 190 is prevented from rotating in the direction of the arrow 198 from the position of the solid line by a stopper (not illustrated; for example, an inner wall of the liquid chamber 171). The actuator 190 includes a float 191, a shaft 192, an arm 193, and a detection target portion 194.

The float 191 is formed of a material having a smaller specific gravity than the ink stored in the liquid chamber 171. The shaft 192 protrudes in the left and right direction 9 from right and left sides of the float 191. The shaft 192 is inserted into a hole (not illustrated) formed in the support member. Thus, the actuator 190 is supported by the support member so as to be rotatable around the shaft 192. The arm 193 extends substantially upwardly from the float 191. The detection target portion 194 is located at a protruding tip of the arm 193. The detection target portion 194 is a plate-like member extending in the up and down direction 7 and the front and back direction 8. The detection target portion 194 is formed of a material or color that shields the light output from the light emitting portion of the liquid level sensor 155.

When a liquid level of the ink stored in the liquid chamber 171 is equal to or higher than a predetermined position P, the actuator 190 rotated in the direction of the arrow 198 by buoyancy is held at the detection position indicated by the solid line in FIG. 3, by the stopper. On the other hand, when the liquid level of the ink is lower than the predetermined position P, the actuator 190 rotates in the direction of the arrow 199 as the liquid level lowers. Thus, the detection target portion 194 moves to a position out of the detection position. That is, the detection target portion 194 moves to a position corresponding to the amount of ink stored in the liquid chamber 171.

The predetermined position P has the same height as an axial center of the needle 181 in the up and down direction 7, and has the same height as a center of an ink supply port 234 (to be described below). However, the predetermined position P is not limited to the position as long as it is located above the outflow port 174 in the up and down direction 7. As another example, the predetermined position P may be a height of the upper end or the lower end of the internal space of the needle 181, or may be a height of an upper end or a lower end of the ink supply port 234.

When the liquid level of the ink stored in the liquid chamber 171 is equal to or higher than the predetermined position P, the light output from the light emitting portion of the liquid level sensor 155 is blocked by the detection target portion 194. Thus, since the light output from the light emitting portion does not reach the light receiving portion, the liquid level sensor 155 outputs a low-level signal to the controller 130. On the other hand, when the liquid level of the ink stored in the liquid chamber 171 is lower than the predetermined position P, since the light output from the light emitting portion reaches the light receiving portion, the liquid level sensor 155 outputs a high-level signal to the controller 130. That is, the controller 130 can detect from the signal output from the liquid level sensor 155 whether the liquid level of the ink stored in the liquid chamber 171 is equal to or higher than the predetermined position P.

[Cartridge 200]

Figure 4A:
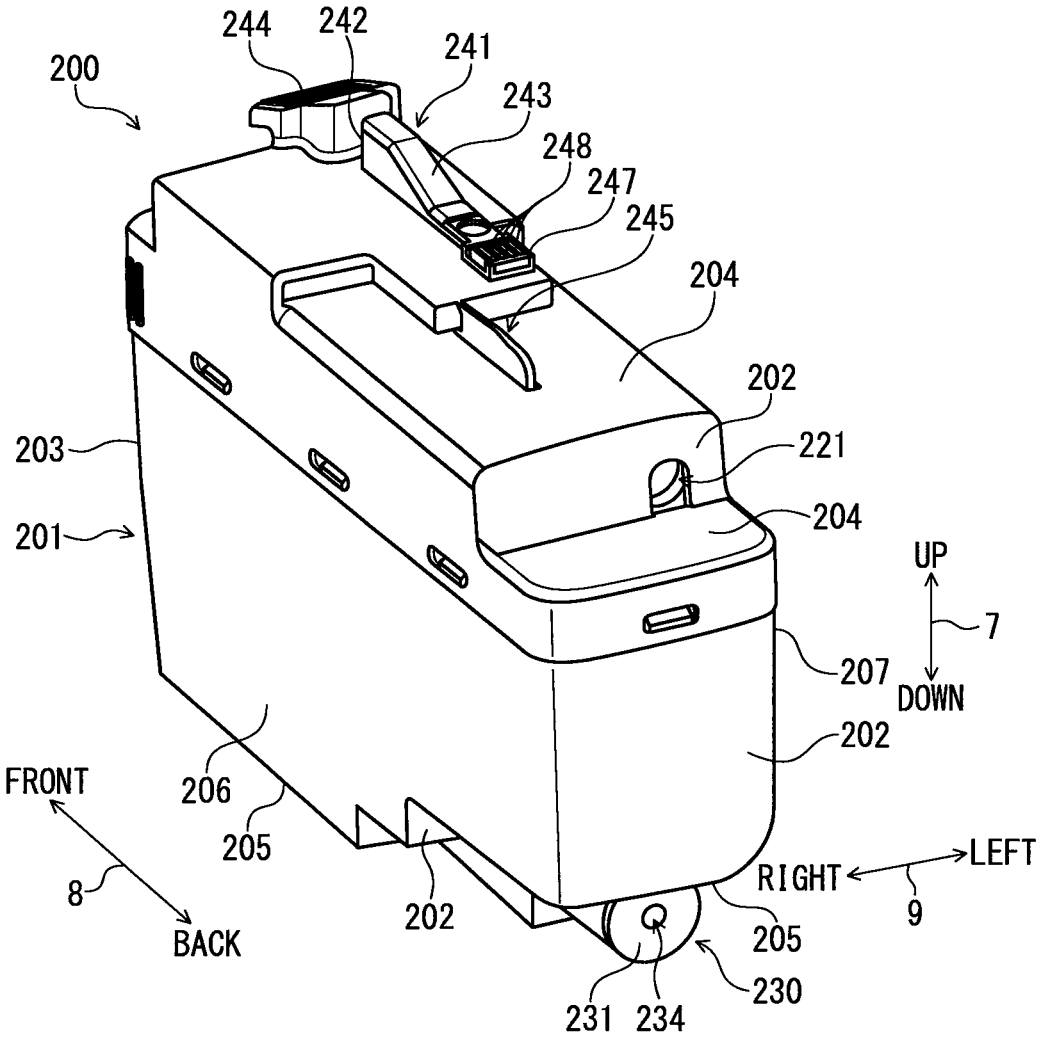
FIG. 4A is a front perspective view illustrating a structure of a cartridge.

The cartridge 200 is a container including a liquid chamber 210 (see FIG. 2) capable of storing ink, which is an example of a liquid, therein. The liquid chamber 210 is defined by a resin wall, for example. As illustrated in FIG. 4A, the cartridge 200 has a flat shape in which dimensions in the up and down direction 7 and the front and back direction 8 are larger than a dimension in the left and right direction 9. The cartridges 200 capable of storing inks of other colors may have the same outer shape or different outer shapes. At least a part of the walls forming the cartridge 200 has translucency. Thus, a user can visually recognize the liquid level of the ink, which is stored in the liquid chamber 210 of the cartridge 200, from the outside of the cartridge 200. The cartridge 200 is an example of a main tank.

The cartridge 200 includes a housing 201 and a supply tube 230. The housing 201 is formed with a rear wall 202, a front wall 203, an upper wall 204, a lower wall 205, and a pair of sidewalls 206 and 207. The rear wall 202 includes a plurality of walls that deviate from each other in the front and back direction 8. In addition, the upper wall 204 includes a plurality of walls that deviate from each other in the up and down direction 7. Further, the lower wall 205 includes a plurality of walls that deviate from each other in the up and down direction 7.

Figure 4B:
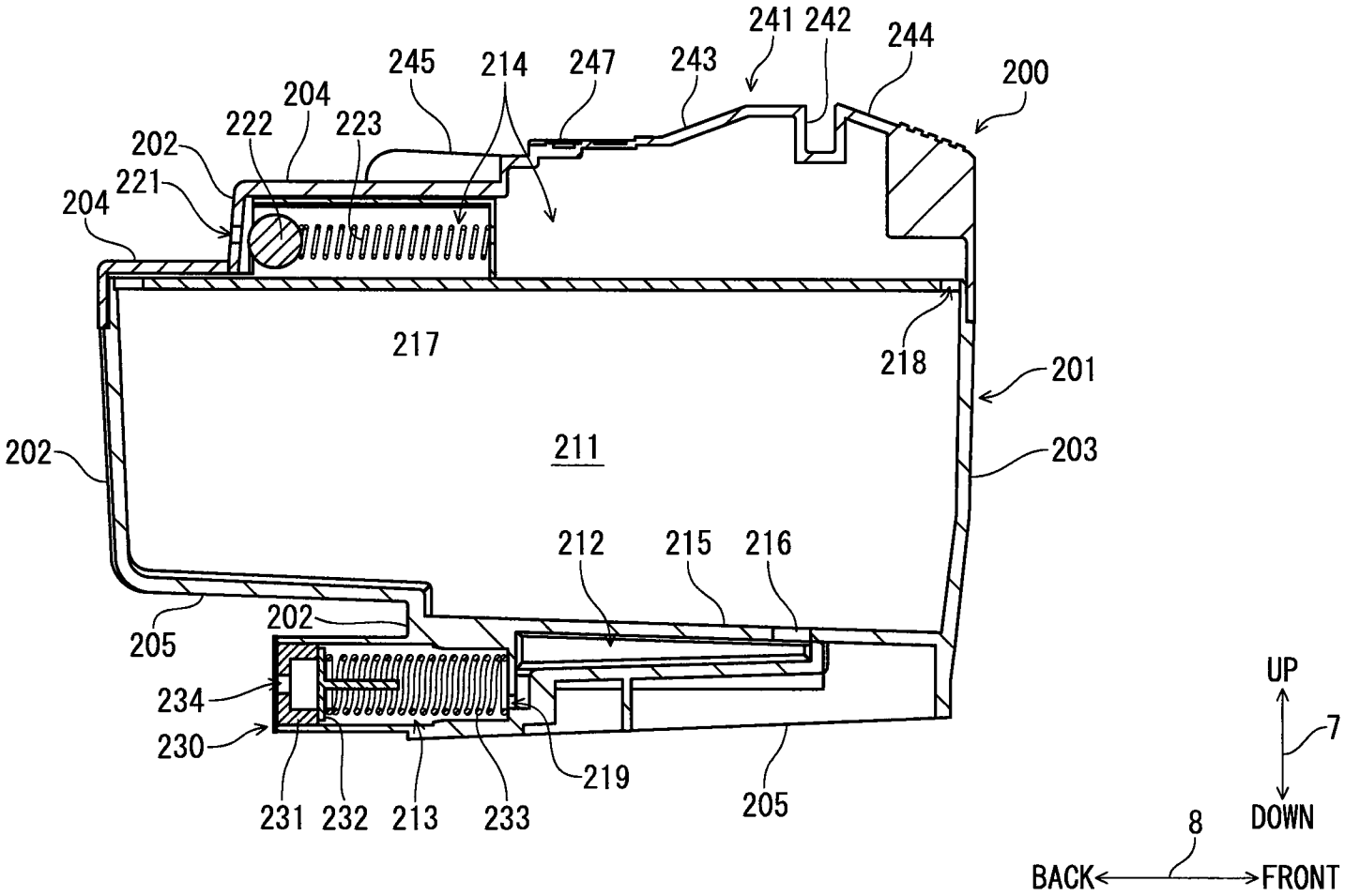
FIG. 4B is a longitudinal sectional view of the cartridge.

In the internal space of the cartridge 200, as illustrated in FIG. 4B, a liquid chamber 210, an ink valve chamber 213, and an air valve chamber 214 are formed. The liquid chamber 210 includes an upper liquid chamber 211 and a lower liquid chamber 212. The upper liquid chamber 211, the lower liquid chamber 212, and the air valve chamber 214 are internal spaces of the housing 201. On the other hand, the ink valve chamber 213 is an internal space of the supply tube 230. The liquid chamber 210 stores ink. The air valve chamber 214 allows the liquid chamber 210 and the outside of the cartridge 200 to communicate with each other. The liquid chamber 210 is an example of a first liquid chamber.

The upper liquid chamber 211 and the lower liquid chamber 212 of the liquid chamber 210 are separated from each other in the up and down direction 7 by a partition wall 215 that partitions the internal space of the housing 201. Then, the upper liquid chamber 211 and the lower liquid chamber 212 communicate with each other through a through-hole 216 formed in the partition wall 215. In addition, the upper liquid chamber 211 and the air valve chamber 214 are separated from each other in the up and down direction 7 by a partition wall 217 that partitions the internal space of the housing 201. Then, the upper liquid chamber 211 and the air valve chamber 214 communicate with each other through a through-hole 218 formed in the partition wall 217. Further, the ink valve chamber 213 communicates with a lower end of the lower liquid chamber 212 through a through-hole 219.

The air valve chamber 214 communicates with the outside of the cartridge 200 through the air communication port 221 formed in the rear wall 202 at the upper part of the cartridge 200. That is, the air valve chamber 214 is an example of a first flow path in which one end (through-hole 218) communicates with the liquid chamber 210 (more specifically, the upper liquid chamber 211) and the other end (air communication port 221) communicates with the outside of the cartridge 200. The air valve chamber 214 communicates with the air through the air communication port 221. In addition, a valve 222 and a coil spring 223 are located in the air valve chamber 214. The valve 222 is movable between a closed position and an opened position in the front and back direction 8. When being located at the closed position, the valve 222 closes the air communication port 221. Further, when being located at the opened position, the valve 222 opens the air communication port 221. The coil spring 223 urges backward the valve 222 in a moving direction from the opened position to the closed position, that is, the front and back direction 8.

The rod 153 enters the air valve chamber 214 through the air communication port 221 in the course of installing the cartridge 200 on the installation case 150. The rod 153 having entered the air valve chamber 214 moves forward the valve 222 located at the closed position against an urging force of the coil spring 223. Then, as the valve 222 moves to the opened position, the upper liquid chamber 211 communicates with the air. The configuration for opening the air communication port 221 is not limited to the above example. As another example, a configuration may be adopted in which the rod 153 breaks through a film that seals the air communication port 221.

The supply tube 230 protrudes backward from the rear wall 202 in the lower part of the housing 201. The protruding end (that is, a rear end) of the supply tube 230 is opened. That is, the ink valve chamber 213 allows the liquid chamber 210 communicating through the through-hole 219 and the outside of the cartridge 200 to communicate with each other. The ink valve chamber 213 is communicated with the liquid chamber 210 (more specifically, the lower liquid chamber 212) at one end (through-hole 219), and the other end (an ink supply port 234 which will be described below) communicates with the outside of the cartridge 200. In the ink valve chamber 213, a packing 231, a valve 232, and a coil spring 233 are located.

At the center of the packing 231, an ink supply port 234 penetrating in the front and back direction 8 is formed. An inner diameter of the ink supply port 234 is slightly smaller than an outer diameter of the needle 181. The valve 232 is movable between a closed position and an opened position in the front and back direction 8. When being located at the closed position, the valve 232 comes in contact with the packing 231 and closes the ink supply port 234. Further, when being located at the opened position, the valve 232 separates from the packing 231 and opens the ink supply port 234. The coil spring 233 urges backward the valve 232 in a moving direction from the opened position to the closed position, that is, the front and back direction 8. In addition, the urging force of the coil spring 233 is larger than that of the coil spring 186.

The supply tube 230 enters the guide 182 in the course of installing the cartridge 200 on the installation case 150, and the needle 181 eventually enters the ink valve chamber 213 through the ink supply port 234. At this time, the needle 181 makes liquid-tight contact with the inner peripheral surface defining the ink supply port 234 while elastically deforming the packing 231.

When the cartridge 200 is further inserted into the installation case 150, the needle 181 moves forward the valve 232 against an urging force of the coil spring 233. In addition, the valve 232 moves backward the valve 185 protruding from the opening 183 of the needle 181 against the urging force of the coil spring 186.

Figure 5:
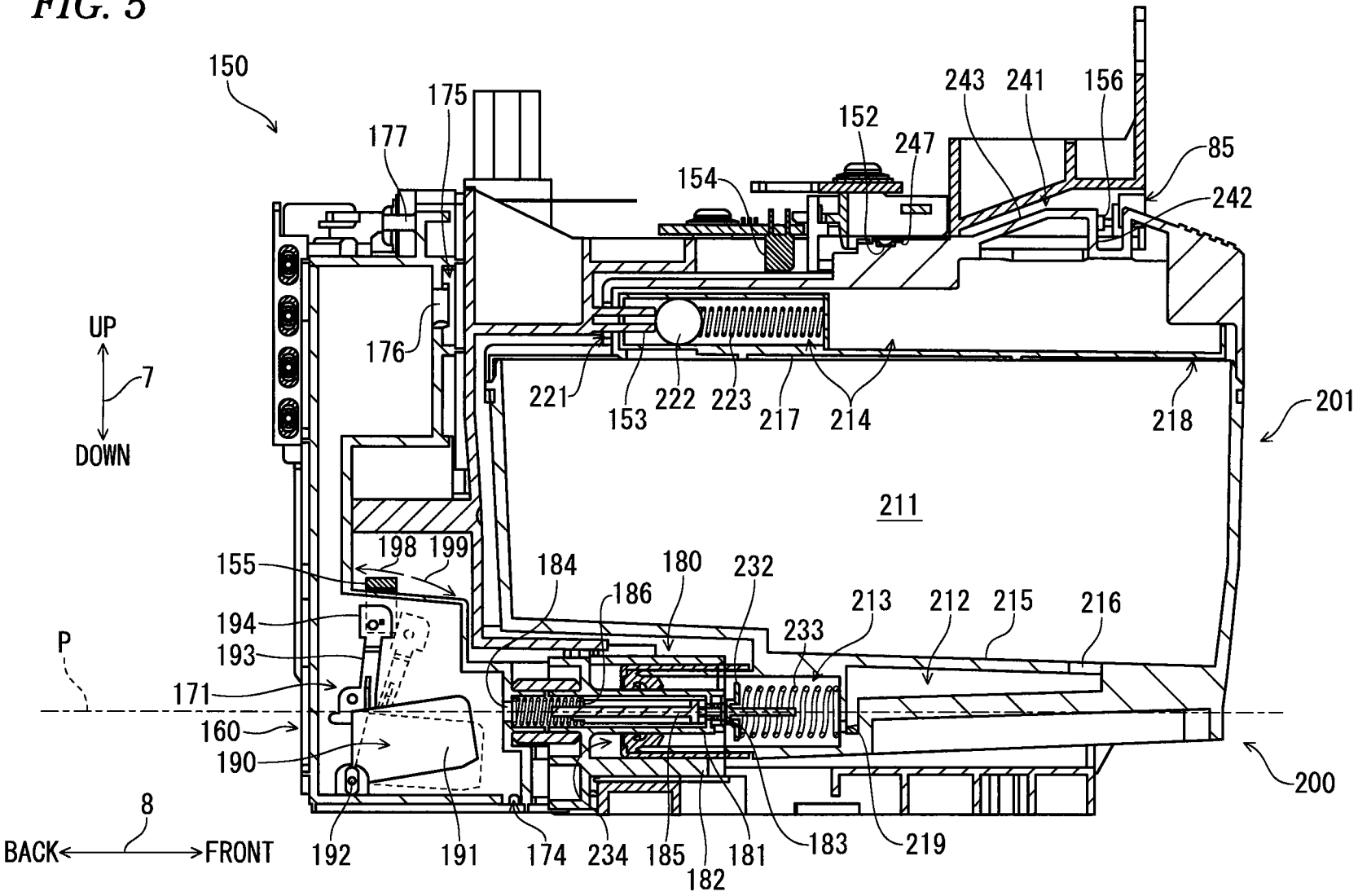
FIG. 5 is a longitudinal sectional view illustrating a state where the cartridge is installed in the installation case.

Thus, as illustrated in FIG. 5, the ink supply port 234 and the opening 183 are opened, and the ink valve chamber 213 of the supply tube 230 communicates with the internal space of the needle 181. That is, in the state where the cartridge 200 is installed in the installation case 150, the ink valve chamber 213 and the internal space of the needle 181 form a flow path, which is an example of a second flow path, through which the liquid chamber 210 of the cartridge 200 communicates with the liquid chamber 171 of the tank 160.

In the state where the cartridge 200 is installed in the installation case 150, a part of the liquid chamber 210 and a part of the liquid chamber 171 overlap each other when viewed in the horizontal direction. As a result, the ink stored in the liquid chamber 210 moves to the liquid chamber 171 of the tank 160 due to a water head difference through the connected supply tube 230 and the joint 180.

As illustrated in FIG. 4, a projection 241 is formed on the upper wall 204. The projection 241 protrudes upward from the outer surface of the upper wall 204 and extends in the front and back direction 8. The projection 241 includes a lock surface 242 and an inclined surface 243. The lock surface 242 and the inclined surface 243 are located above the upper wall 204. The lock surface 242 is directed to the front side in the front and back direction 8 and extends in the up and down direction 7 and the left and right direction 9 (that is, being substantially orthogonal to the upper wall 204). The inclined surface 243 is inclined with respect to the upper wall so as to be directed upward in the up and down direction 7 and backward in the front and back direction 8.

The lock surface 242 is a surface to be brought into contact with the lock pin 156 in the state where the cartridge 200 is installed in the installation case 150. The inclined surface 243 is a surface for guiding the lock pin 156 to a position where the lock pin comes in contact with the lock surface 242 in the course of installing the cartridge 200 on the installation case 150. In the state where the lock surface 242 and the lock pin 156 are in contact with each other, the cartridge 200 is held at the installation position illustrated in FIG. 5 against the urging force of the coil springs 186, 223, and 233.

A flat plate-like member is formed in front of the lock surface 242 so as to extend upward from the upper wall 204. An upper surface of the flat plate-like member corresponds to an operation portion 244 to be operated by a user when the cartridge 200 is removed from the installation case 150. When the cartridge 200 is installed in the installation case 150 and the cover 87 is located at the exposing position, the operation portion 244 can be operated by the user. When the operation portion 244 is pushed downward, the cartridge 200 rotates, and thus the lock surface 242 moves downward from the lock pin 156. As a result, the cartridge 200 can be removed from the installation case 150.

The light shielding rib 245 is formed on the outer surface of the upper wall 204 and behind the projection 241. The light shielding rib 245 protrudes upward from the outer surface of the upper wall 204 and extends in the front and back direction 8. The light shielding rib 245 is formed of a material or color that shields the light output from the light emitting portion of the installation sensor 154. The light shielding rib 245 is located on an optical path extending from the light emitting portion to the light receiving portion of the installation sensor 154 in the state where the cartridge 200 is installed in the installation case 150. That is, the installation sensor 154 outputs a low-level signal to the controller 130 when the cartridge 200 is installed in the installation case 150. On the other hand, the installation sensor 154 outputs a high-level signal to the controller 130 when the cartridge 200 is not installed in the installation case 150. That is, the controller 130 can detect whether the cartridge 200 is installed in the installation case 150, depending on a signal output from the installation sensor 154.

An IC substrate 247 is located on the outer surface of the upper wall 204 and between the light shielding rib 245 and the projection 241 in the front and back direction 8. On the IC substrate 247, an electrode 248 is formed. In addition, the IC substrate 247 includes a memory (not illustrated). The electrode 248 is electrically connected to the memory of the IC substrate 247. The electrode 248 is exposed on an upper surface of the IC substrate 247 so as to be electrically connectable with the contact 152. That is, the electrode 248 is electrically connected to the contact 152 in the state where the cartridge 200 is installed in the installation case 150. The controller 130 can read information from the memory of the IC substrate 247 through the contact 152 and the electrode 248, and can write information to the memory of the IC substrate 247 through the contact 152 and the electrode 248.

The memory of the IC substrate 247 stores a maximum ink amount Vc0 an ink amount Vc and identification information for identifying the individual of the cartridge 200. The maximum ink amount Vc0 is an example of the maximum liquid amount indicating the maximum amount of ink that can be stored in the cartridge 200. In other words, the maximum ink amount Vc0 indicates the amount of ink stored in the new cartridge 200. Hereinafter, information stored in the memory of the IC substrate 247 may be collectively referred to as "CTG information" in some cases. Further, the "new" is a so-called unused item and indicates a state in which the ink stored in the cartridge 200 has never flowed out from the cartridge 200 which is manufactured and sold.

A storage region of the memory of the IC substrate 247 includes, for example, a region where information is not overwritten by the controller 130 and a region where information can be overwritten by the controller 130. For example, identification information and the maximum ink amount Vc0 are stored in the non-overwritable region that is not overwritten, and the ink amount Vc is stored in the overwritable region.

[Controller 130]

As illustrated in FIG. 6, the controller 130 includes a CPU 131, a ROM 132, a RAM 133, an EEPROM 134, and an ASIC 135. The ROM 132 stores various programs that allow the CPU 131 to control various operations. The RAM 133 is used as a storage region which temporarily records data or signals to be used when the CPU 131 executes the programs or a work region where data is processed. The EEPROM 134 stores setting information which should be retained even after the power is turned off. The ROM 132, the RAM 133, and the EEPROM 134 are examples of memories.

The ASIC 135 is used to operate the feed roller 23, the conveyance roller 25, the discharge roller 27, and the head 21. The controller 130 rotates the feed roller 23, the conveyance roller 25, and the discharge roller 27 by driving a motor (not illustrated) through the ASIC 135. In addition, the controller 130 outputs a driving signal to a driving element of the head 21 through the ASIC 135, thereby causing the head 21 to discharge ink through the nozzle 29. The ASIC 135 can output a plurality types of driving signals depending on the amount of ink to be discharged through the nozzle 29.

Further, a display 17 and an operation panel 22 are connected to the ASIC 135. The display 17 is a liquid crystal display, an organic EL display, or the like, and includes a display screen on which various types of information are displayed. The display 17 is an example of a notification device. However, specific examples of the notification device are not limited to the display 17, and may include a speaker, an LED lamp, or a combination thereof. The operation panel 22 outputs an operation signal corresponding a user's operation to the controller 130. For example, the operation panel 22 may include a push button, or may include a touch sensor overlaid on the display 17.

Further, the ASIC 135 is connected with the contact 152, the cover sensor 88, the installation sensor 154, and the liquid level sensor 155. The controller 130 accesses the memory of the IC substrate 247 of the cartridge 200 installed in the installation case 150 through the contact 152. The controller 130 detects the position of the cover 87 through the cover sensor 88. In addition, the controller 130 detects insertion and removal of the cartridge 200 through the installation sensor 154. Further, the controller 130 detects through the liquid level sensor 155 whether the liquid level of the ink stored in the liquid chamber 171 is equal to or higher than the predetermined position P.

When liquid level sensor 155 outputs a high-level signal, the ROM 132 stores a predetermined ink amount Vsc stored in the liquid chamber 171 of the tank 160 and a predetermined ink amount Vcc stored in the liquid chamber of the cartridge 200. The predetermined ink amount Vcc is zero in the embodiment.

The EEPROM 134 stores various types of information in correlation with four cartridges 200 installed in the installation case 150, namely, in correlation with the tanks 160 communicating with the cartridges 200. The various types of information includes, for example, ink amounts Vc and Vs which are examples of the liquid amount, a function F, a C_Empty flag, an S_Empty flag, a count value SN, a count value TN, a threshold Nth, and a waiting time Tw.

The ink amount Vc and the identification information are information read by the controller 130 from the memory of the IC substrate 247 through the contact 152 in a state where the cartridge 200 is installed in the installation case 150. The function F may be stored in the ROM 132 instead of the EEPROM 134.

The ink amount Vc indicates the amount of ink stored in the liquid chamber 210 of the cartridge 200. The ink amount Vs indicates the amount of ink stored in the liquid chamber 171 of the tank 160. The ink amounts Vc and Vs are calculated by the function F. The function F is information indicating a corresponding relation of the total amount Vt of ink, the ink amount Vc, and the ink amount Vc. The ink in the liquid chamber 210 of the cartridge 200 and the ink in the liquid chamber 171 of the tank 160 are in equilibrium in a state where positions in the vertical direction 7 of the liquid levels of the respective inks coincide with each other. That is, the movement of the ink between the liquid chamber 210 and the liquid chamber 171 is stopped. For example, the relation between the total amount Vt of ink and the ink amount Vs can be approximated by the function F. Accordingly, when the total amount Vt of ink is calculated, the ink amount Vs and the ink amount Vc are obtained. The ink amount Vs and the ink amount Vc are not limited to the form of the function F, and may be obtained by a table correlated with the total amount Vt. The total amount Vt is an example of the total liquid amount.

The count value SN is a value equivalent to an ink discharge amount Dh (that is, the ink amount indicated by the driving signal) instructed to be discharged from the head 21 and is a value that is updated closer to the threshold Nth, after the signal output from the liquid level sensor 155 changes from the low-level signal to the high-level signal. The count value SN is a value counted up with an initial value being "0". In addition, the threshold Nth is equivalent to a volume of the liquid chamber 171 between the vicinity of the upper end of the outflow port 174 and the predetermined position P. However, the count value SN may be a value counted down with a value equivalent to the volume as an initial value. In this case, the threshold Nth1 is zero (0).

The count value TN is a value equivalent to an ink discharge amount Dh (that is, the ink amount indicated by the driving signal) instructed to be discharged from the head 21 and is a value counted up with an initial value being "0", after the signal output from the liquid level sensor 154 changes from the high-level signal to the low-level signal. Further the count value TN may be a value counted down with a value equivalent to the total amount Vt of ink as an initial value.

The C_Empty flag is information indicating whether the cartridge 200 is in a cartridge empty state. In the C_Empty flag, a value "ON" corresponding to the cartridge empty state or a value "OFF" corresponding to non-cartridge empty state is set. The cartridge empty state is a state where ink is not substantially stored in the cartridge 200 (more specifically, the liquid chamber 210). In other words, the cartridge empty state is a state where ink does not move from the liquid chamber 210 to the liquid chamber 171 communicating with the cartridge 200. Namely, the cartridge empty state is a state where the liquid level of the tank 160 communicating with the cartridge 200 is lower than the predetermined position P.

The S_Empty flag is information indicating whether the tank 160 is in an ink empty state. In the S_Empty flag, a value "ON" corresponding to the ink empty state or a value "OFF" corresponding to non-ink empty state is set. The ink empty state is, for example, a state where the liquid level of the ink stored in the tank 160 (more specifically, the liquid chamber 171) reaches the position of the upper end of the outflow port 174. In other words, the ink empty state is a state where the count value SN1 is equal to or larger than the threshold Nth1. When the ink is continuously discharged from the head 21 after the ink empty state, the liquid level of the ink in the tank 160 may fall below the upper end of the outflow port 174, and air may be mixed in an ink flow path from the tank 160 to the head 21 or in the head 21 (so called air-in). As a result, the inside of the nozzle 29 is filled with the ink, and the ink may not be discharged.

[Operation of Printer 10]

Figure 7:
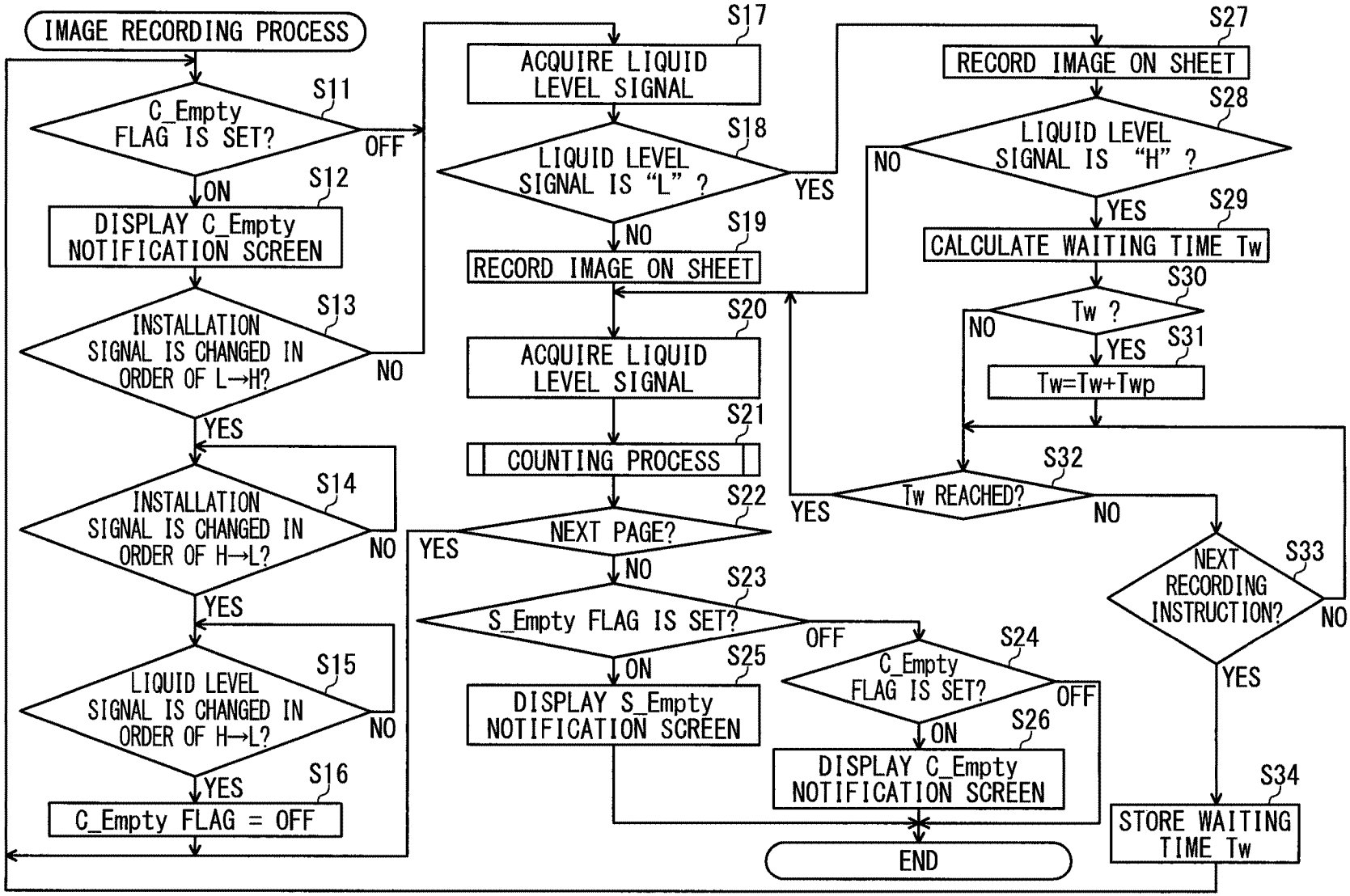
FIG. 7 is a flowchart of an image recording process.
Figure 8:
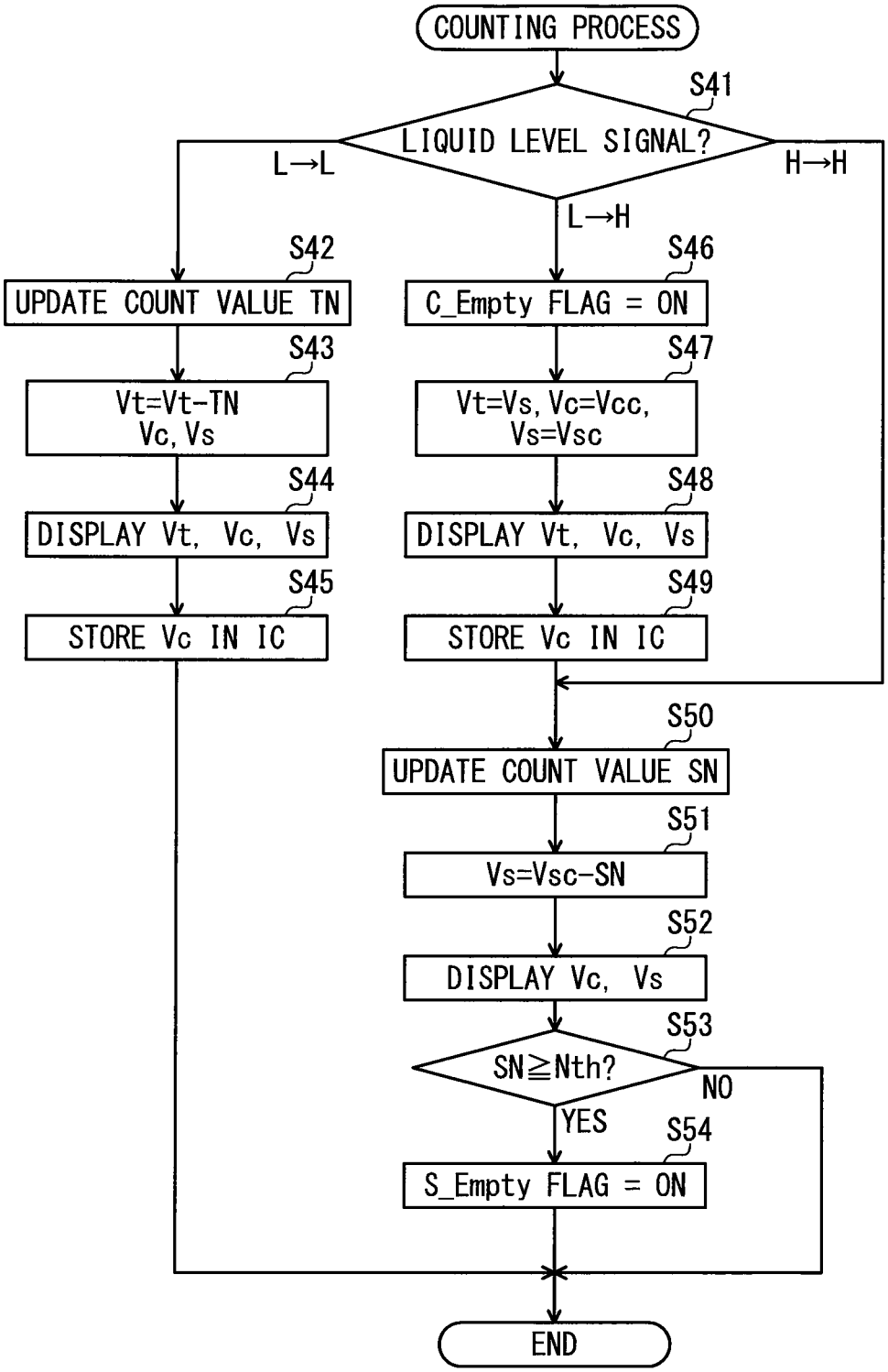
FIG. 8 is a flowchart of a counting process.

An operation of the printer 10 according to the embodiment will be described with reference to FIGS. 7 and 8. Each of processes illustrated in FIGS. 7 and 8 is executed by the CPU 131 of the controller 130. Each of the following processes may be executed by the CPU 131 reading programs stored in the ROM 132, or may be implemented a hardware circuit installed in the controller 130. Further, execution orders of the following processes can be appropriately changed.

[Image Recording Process]

The controller 130 executes an image recording process illustrated in FIG. 7 in response to a recording instruction being input to the printer 10. The recording instruction is an example of a discharge instruction for causing the printer 10 to execute a recording process of recording an image indicated by image data on a sheet. An acquisition destination of the recording instruction is not particularly limited, but, for example, a user's operation corresponding to the recording instruction may be accepted through the operation panel 22 or may be received from an external device through a communication interface (not illustrated).

First, the controller 130 determines set values of four C_Empty flags (S11). Then, the controller 130 displays a C_Empty notification screen on the display 17 (S12) in response to determining that at least one of the four C_Empty flags is set to "ON" (S11: ON). In step S12, the controller 130 may display the S_Empty notification screen on the display 17 together with the C_Empty notification screen in response to determining that at least one of the four S_Empty flags is set to "ON". The operation of the display 17 in S12 is an example of a first operation.

In addition, the controller 130 executes processes S13 to S16 for each the cartridge 200 corresponding to the C_Empty flag set to "ON". That is, the processes is executed for each the cartridge 200 among the four cartridges 200 in which the C_Empty flag is set to "ON". Since the processes S13 to S16 for each the cartridge 200 is common, only the processes S13 to S16 corresponding to one cartridge 200 will be described.

First, the controller 130 determines whether the signal acquired from the installation sensor 154 changes into the high-level signal from the low-level signal (S13). The controller 130 acquires signals output from four liquid level sensors 155 (S17) at the present time when the signal acquired from the installation sensor 154 changes from the low-level signal (S13: No).

When the controller 130 determines that the signal acquired from the installation sensor 154 changed into a high-level signal from a low-level signal (S13: Yes), the controller 130 repeatedly executes the processes S14 at predetermined time intervals until the signal output from the installation sensor 154 changes into the low-level signal from the high-level signal (S14: No). In other words, the controller 130 repeatedly executes the processes S14 until the cartridge 200 is removed from the installation case 150 and a new cartridge 200 is installed in the installation case 150.

Then, the controller 130 acquires the low-level signal from the installation sensor 154 after acquiring the high-level signal from the installation sensor 154 (S14: Yes), and then determines whether the signal received from the liquid level sensor 155 changes into the low-level signal from the high-level signal (S15). The controller 130 monitors the signal received from the liquid level sensor 155 at a predetermined time when the controller 130 determines that the signal received from the liquid level sensor 155 does not change from the high-level signal (S15: No). When the controller 130 determines that the signal received from the liquid level sensor 155 changes into the low-level signal from the high-level signal (S15: Yes), the controller 130 sets the C_Empty flag to "OFF" and erases the C_Empty notification screen from the display 17. Then, the controller 130 executes steps subsequent to S11 again.

The controller 130 acquires signals output from four liquid level sensors 155 at the present time when all the C_Empty corresponding to all the cartridges 200 are not "ON", that is, are "OFF" (S17). In S17, the controller 130 further causes the RAM 133 to store information indicating whether the signal acquired from the liquid level sensor 155 is a high-level signal or a low-level signal.

Then, the controller 130 determines whether the signal acquired from the liquid level sensor 155 is a low-level signal (S18). When determining that the signal acquired from the liquid level sensor 155 is not the low-level signal (S18: No), but a high-level signal acquired from the liquid level sensor 155, the controller 130 records the image indicated by the image data included in the recording instruction on the sheet (S19). More specifically, the controller 130 causes the sheet on the feed tray 15 to be conveyed to the feed roller 23 and the conveyance roller 25, causes the head 21 to discharge the ink, and causes the sheet, on which the image is recorded, to be discharged to the discharge roller 27 via the discharge tray 16.

Next, the controller 130 acquires signals output from the four liquid level sensors 155 at the present time in response to recording the image on sheet according to the recording instruction (S20). Further, similarly to step S17, the controller 130 causes the RAM 133 to store information indicating whether the signal acquired from the liquid level sensor 155 is a high-level signal or a low-level signal (S20). Then, the controller 130 executes a counting process (S21). The counting process is a process of updating the count values TN, SN, and SN2, the C_Empty flag, and the S_Empty flag based on the signal acquired from the liquid level sensor 155 in steps S17 and S19. Details of the counting process will be described below with reference to FIG. 8.

Next, the controller 130 repeatedly executes the processes S11 to S20 until all the images indicated by the recording instruction are recorded on the sheet (S22: Yes). Then, the controller 130 determines set values of the four S_Empty flags and set values of the four C_Empty flags in response to recording all the images indicated by the recording instruction on the sheet (S22: No) (S23 and S24).

When at least one of the four S_Empty flags is set to "ON" (S23: ON), the controller 130 displays the S_Empty notification screen on the display 17 (S25). In addition, when all of the four S_Empty flags are set to "OFF" and at least one of the four C_Empty flags is set to "ON" (S23: OFF & S24: ON), the controller 130 displays the C_Empty notification screen on the display 17 (S26). The process S26 is an example of operating the notification device.

The S_Empty notification screen displayed in step S24 may be the same as in step S12. In addition, the C_Empty notification screen is a screen for informing the user that the cartridge 200 corresponding to the C_Empty flag set to "ON" has entered the cartridge empty state. For example, the C_Empty notification screen may include information related to the color and the ink amounts Vc and Vs of the ink stored in the cartridge 200 being in the cartridge empty state. On the other hand, when all of the four S_Empty flags and the four C_Empty flags are set to "OFF" (S24: OFF), the controller 130 completes the image recording process without executing the processes S25 and S26.

The S_Empty notification screen is a screen for informing the user that the corresponding tank 160 is in the ink empty state and the ink cannot be discharged through the head. For example, the S_Empty notification screen may include information relating to the color and the ink amounts Vc and Vs of the ink stored in the tank 160 being in the ink empty state.

In S18, when determining that the acquired signal of the liquid level sensor 155 is a low-level signal (S18: Yes), the controller 130 records the image indicated by the image data included in the recording information on the sheet as in S19 (S27). The controller 130 determines whether the signal received from the liquid level sensor 155 is a high-level signal, in response to the recording of the image on the sheet according to the recording instruction (S28). Further, the controller 130 causes the RAM 133 to store the time at which the image recording is completed.

Figure 9A:
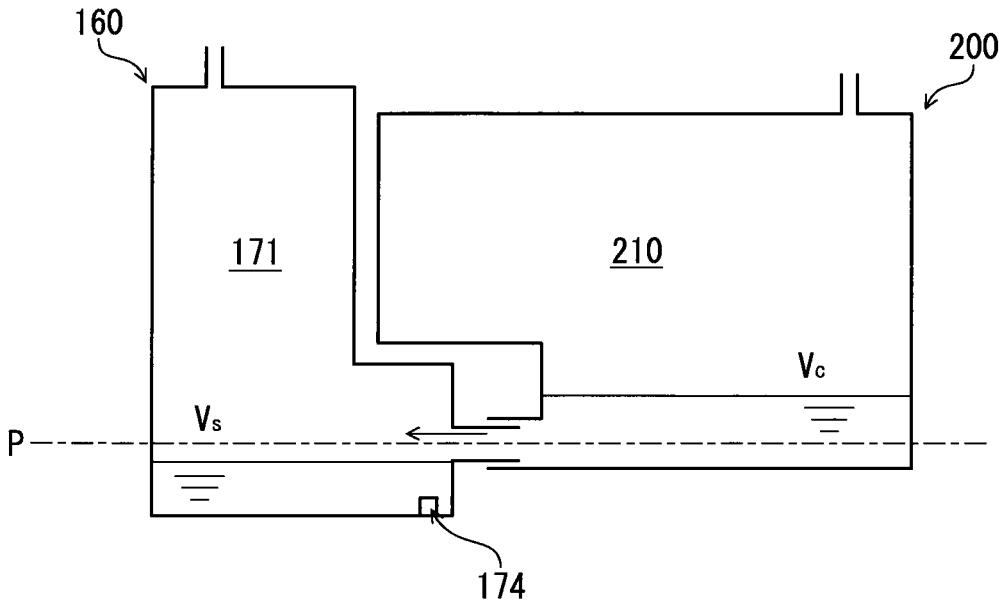
FIG. 9A is a schematic view illustrating a state in which a liquid level of a liquid chamber having water head difference is lower than a predetermined position.
Figure 9B:
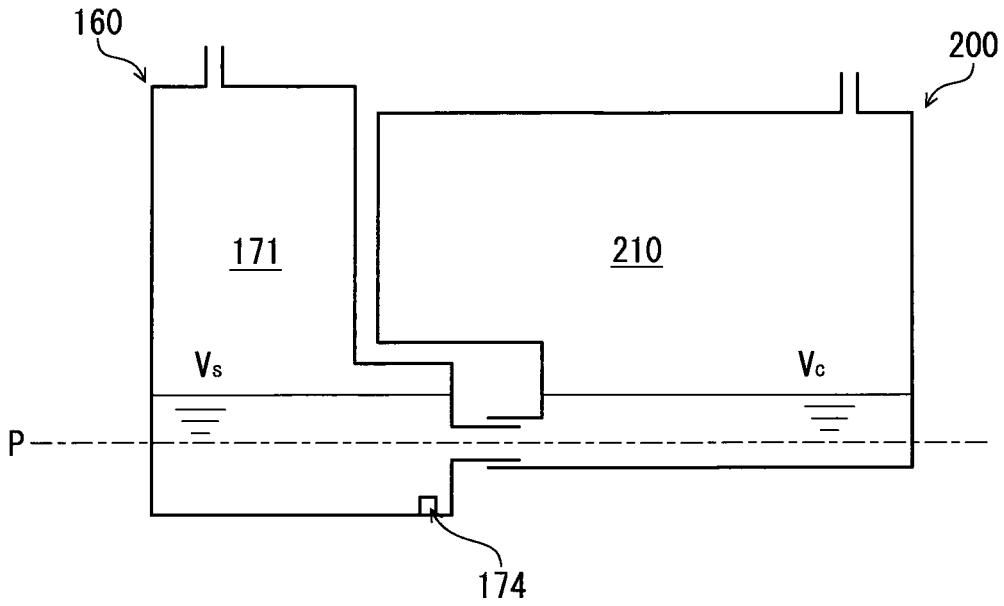
FIG. 9B is a schematic view illustrating a state in which a liquid level of a liquid chamber having water head difference is equal to or higher than a predetermined position.

As the ink is discharged from the head 21 in the image recording, the ink flows out from the liquid chamber 171 of the tank 160 through outflow port 174. On the other hand, the ink flows into the liquid chamber 171 from the liquid chamber 210 (lower liquid chamber 212) of the cartridge 200 through a needle 181. In comparison between the flow rate Qs at which the ink flows out from the liquid chamber 171 and the flow rate Qc at which the ink flows into the liquid chamber 171, when the flow rate Qs is sufficiently larger than the flow rate Qc, an imbalance, that is, a water head difference occurs between the liquid level of the ink in the liquid chamber 171 and the liquid level of the ink in the liquid chamber 210, and thus the liquid level of the ink in the liquid chamber 171 is lower than the liquid level of the ink in the liquid chamber 210. As illustrated in FIG. 9A, when the liquid level of the ink in the liquid chamber 171 is lower than the predetermined position P in a state where the water head difference occurs, the controller 130 receives a high-level signal from the liquid level sensor 155. When the image recording is completed, the ink flows into the liquid chamber 171 from the liquid chamber 210 due to the water head difference, and as illustrated in FIG. 9B, the liquid level of the ink in the liquid chamber 171 has the same height as the liquid level of the ink in the liquid chamber 210.

The controller 130 executes steps S19 to S26 when determining that the signal received from the liquid level sensor 155 is not a high-level signal (S28: No), that is, when the signal received from the liquid level sensor 155 is a low-level signal.

The controller 130 calculates a waiting time Tw (S29) in response to determining that the signal received from the liquid level sensor 155 is a high-level signal (S28: Yes). The waiting time Tw is set corresponding to an ink amount ΔV discharged per unit time through the head 21, the ink amount ΔV being calculated based on the ink discharge amount Dh instructed in S27. The waiting time Tw is a time for eliminating the above-described water head difference occurring in the liquid chambers 171 and 210. Since the water head difference becomes large when the ink amount ΔV is large, the waiting time Tw becomes longer. The waiting time Tw may be calculated based on a function indicating the relation between the ink amount ΔV and the waiting time Tw, and may be determined based on a table in which the ink amount ΔV and the waiting time Tw are correlated with each other. The ink discharge amount Dh is an example of information relating to the discharge of liquid from the head.

The controller 130 determines whether the RAM 133 stores a previous waiting time Twp, after calculating the waiting time Tw (S30). The controller 130 adds the previous waiting time Twp to the calculated waiting time Tw to set a waiting time Tw (S31) and executes step S32 (which will be described below) when the RAM 133 stores the previous waiting time Twp (S30: Yes). The controller 130 determines the calculated waiting time Tw as a waiting time Tw and executes step S32 (which will be described below) when the RAM 133 does not store the previous waiting time Twp (S30: No).

In S32, the controller 130 determines whether the elapsed time from the time at which the image recording is completed, that is, the time stored in the RAM 133 reaches the waiting time Tw (S32). The controller 130 executes steps from S20 to S26 when determining that the elapsed time from the time stored in the RAM 133 reaches the waiting time Tw (S32: Yes). As the waiting time Tw elapses, the above-described water head difference occurring in the liquid chambers 171 and 210 is eliminated. Therefore, even when the liquid level of the ink in the liquid chamber 171 is lower than the predetermined position P in the state where the water head difference occurs as illustrated in FIG. 9A, if the liquid level of the ink in the liquid chamber 171 is equal to or higher than the predetermined position P when the water head difference is eliminated as illustrated in FIG. 9B, the RAM 133 stores a low-level signal as the signal acquired from the liquid level sensor 155 in S20.

The controller 130 determines whether another recording instruction is input (S33) when determining that the elapsed time from the time stored in the RAM 133 does not reach the waiting time Tw (S32: No). The controller 130 executes steps S32 and S33 again when another recording instruction is not input (S33: No).

The controller 130 causes the RAM 133 to store the determined waiting time Tw as the previous waiting time Twp (S34) when determining that another recording instruction is input (S33: Yes). Then, the controller 130 executes steps subsequent to S11.

A specific example of the discharge instruction is not limited to the recording instruction, but may be a maintenance instruction instructing maintenance of the nozzle 29 such as a purge. For example, the controller 130 executes the same processes as in FIG. 7 in response to acquiring the maintenance instruction. Differences from the above-described processes in the case of acquiring the maintenance instruction are as follows. First, the controller 130 drives a maintenance mechanism (not illustrated) in step S19, and discharges the ink through the nozzle 29. In addition, the controller 130 executes the processes of step S22 and the subsequent steps without executing step S22 after executing the counting process.

[Counting Process]

Next, details of the counting process executed by the controller 130 in S20 will be described with reference to FIG. 8. The controller 130 independently executes the counting process with respect to each of the four cartridges 200. Since the counting process is common for each cartridge 200, only the counting process corresponding to one cartridge 200 will be described.

First, the controller 130 compares information indicating the signals of the liquid level sensors 155 stored in the RAM 133 in S17 and S20 with one another (S41). That is, the controller 130 determines a change in the signal of each of the four liquid level sensors 155 before and after the process of S19 is executed before the counting process (S21) is executed.

The controller 130 executes the residual amount updating process in response to the fact (S41: L→L) that the information stored in the RAM 133 in steps S17 and S20 indicates the low-level signal (that is, there is no change in the output of the liquid level sensors 155 before and after the process of S19) (S42). That is, the controller 130 counts up the count value TN which is a value equivalent to the amount of ink instructed to be discharged in the previous step S19.

In addition, the controller 130 calculates the current total amount Vt (S43). First, the controller 130 calculates the total amount Vt of the exchanged cartridge which is the sum of the ink amount Vc and the ink amount Vs stored in the EEPROM 134 after exchange of the cartridge. Then, the controller 130 calculates the current total amount Vt (Vt=Vt−TN) which is a value obtained by subtracting the ink amount equivalent to the count value TN from the calculated total amount Vt. Then, the controller 130 obtains the ink amounts Vc and Vs based on the calculated current total amount Vt, the function F1 and the function F2 (S43).

Then, the controller 130 displays either one of both the current ink amount Vc and ink amount Vs and the current total amount Vt on the display 17 (S44). Further, the controller 130 overwrites the obtained ink amount Vc with the ink amount Vc stored in the memory of the IC substrate 247 of the cartridge 200 (S45).

Further, the controller 130 puts "ON" into the C_Empty flag in response to the fact (S41: L→H) that the information stored in the RAM 133 in S17 indicates the low-level signal and the information stored in the RAM 133 in S20 indicates the high-level signal (that is, there is change in the output of the liquid level sensors 155 before and after the process of S19) (S46).

The change from the low-level signal into the high-level signal in the output of the liquid level sensors 155 corresponds to the fact that the liquid level of the liquid chamber 171 reaches the predetermined position P when the waiting time Tw elapses after the process of S19. Then, there is no ink movement between the cartridge 200 and the tank 160.

In addition, the controller 130 reads a predetermined ink amount Vcc (=0) from the ROM 132, and sets the ink amount Vc to the predetermined ink amount Vcc (S47). Similarly, the controller 130 reads a predetermined ink amount Vsc (corresponding to the volume of the liquid chamber 171 below the predetermined position P) from the ROM 132, and sets the ink amount Vs to the predetermined ink amount Vsc (S47). Since the ink amounts Vc and Vs calculated in the residual amount updating process include errors, the controller 130 sets the ink amount Vc to the predetermined ink amount Vcc at the timing when the output of the liquid level sensor 155 changes from the low-level signal to the high-level signal, and sets the ink amount Vs to the predetermined ink amount Vsc, thereby resetting the accumulated errors. Further, the controller 130 calculates the current total amount Vt as a value equal to the ink amount Vs (Vt=Vsc) (S47). As the ink amount Vc becomes zero, the total amount Vt has the same value as the ink amount Vs.

Then, the controller 130 displays either one of both the current ink amount Vc and ink amount Vs and the current total amount Vt on the display 17 (S48). In addition, the controller 130 overwrites the ink amount Vc stored in the memory of the IC substrate 247 of the cartridge 200 (S49) with the above-described ink amount Vc (=0).

In addition, the controller 130 counts up the count value SN stored in EEPROM 134 with the value corresponding to an ink discharge amount Dh instructed to be discharged in the step S19 (S50). In other words, the controller 130 starts to update the count value SN in response to the change from the low-level signal into the high-level signal in the output of the liquid level sensors 155. The controller 130 counts up the count value TN stored in the EEPROM 134 with a value corresponding to the amount of ink instructed to be discharged in the step S19.

Then, the controller 130 calculates the ink amount Vs (S51). The calculated ink amount Vs is a value obtained by subtracting from the ink amount corresponding to the count value SN stored in the EEPROM 134 from the predetermined ink amount Vsc stored in the ROM 132. As described above, after the output of the liquid level sensor 155 becomes the high-level signal, the ink amount Vs is the same value as the current total amount Vt. In addition, the ink amount Vc is zero.

Then, the controller 130 displays either one of both the calculated current ink amount Vc and ink amount Vs and the calculated current total amount Vt on display 17 (S52). Since the ink amount Vc is zero after the output of liquid level sensor 155 becomes the high-level signal, the controller 130 does not need to overwrite the ink amount Vc stored in the memory of the IC substrate 247 of the cartridge 200.

Next, the controller 130 compares the count value SN updated in step S50 with the threshold Nth1 (S53). When it is determined that the count value SN updated in step S50 is smaller than the threshold Nth (S53: No), the controller 130 ends counting process without executing step S54. On the other hand, when it is determined that the count value SN updated in step S50 is equal to or more than the threshold Nth (S53: Yes), the controller 130 puts "ON" into the S_Empty flag (S54). Then, the controller 130 prohibits the discharge of the ink through the head 21 and completes the counting process when the S_Empty flag is set to "ON".

Furthermore, the controller 130 reads the count value SN stored in the EEPROM 134 in response to the fact (S41: H→H) that both information stored in the RAM 133 in steps S17 and S20 indicates the high-level signal. Then the controller 130 adds the ink discharge amount to the read count value SN and stores the value in the EEPROM 134 again. That is, the controller 130 updates the count value SN (S50). The controller 130 also updates the count value TN. Next, the controller 130 executes the process from step S51 to step S54 described above using the count value SN updated in step S50.

[Operational Effect]

According to the embodiment, even when the position of the liquid level of the liquid chamber 171 of the tank 160 temporarily descends by the discharge of the ink through the head 21, and then ascends again, the signal received from the liquid level sensor after the waiting time Tw elapses is determined by the controller 130. It is suppressed that the controller 130 determines a signal of the liquid level sensor 155 due to a position of the temporarily descending liquid level.

The waiting time Tw is set in correspondence with an ink amount ΔV per unit time of the ink discharged through the head 21 according to a recording instruction. As the ink amount per unit time of the ink discharged through the head 21 is increased, a time taken for ascending again after the position of the liquid level of the liquid chamber 171 of the tank 160 temporarily descends is lengthened. Therefore, the waiting time Tw corresponding to the time can be set.

If the high-level signal is not received from the liquid level sensor 155 after the discharge of the ink through the head 21 is completed, there is no change in the signal received from the liquid level sensor 155 even when the position of the liquid level of the liquid chamber 171 ascends after the time elapses. According to the embodiment, the waiting time Tw is not requested in such a case, the counting process can be executed based on the signal received from the liquid level sensor 155.

In a case where the ink starts to be discharged through the head 21 when the low-level signal is not received from the liquid level sensor 155, the signal received from the liquid level sensor 155 is not changed after the discharge of the ink through the head 21 is completed. According to the embodiment, the waiting time Tw is not requested in such a case, the counting process can be executed based on the signal received from the liquid level sensor 155.

The controller 130 stores the waiting time Tw in the RAM 133 as the waiting time Twp at the last time in response to the next recording instruction before the waiting time Tw elapses after the discharge of the ink from the head 21 is completed. Before the waiting time Tw elapses, the ink starts to be discharged through the head 21 in response to the recording instruction. Therefore, the user does not need to wait for time until the ink starts to be discharged after the next recording instruction is input. Then, when the discharge of the ink in response to the next recording instruction is completed, the signal received from the liquid level sensor 155 is waited until the waiting time Tw obtained by adding the previous waiting time Twp stored in the RAM 133 to the waiting time Tw requested at the next time elapses. The waiting time Tw until the position of the liquid level ascends again can be set in addition to the descending amount of the position of the liquid level of the liquid chamber 171 generated by the previous discharge of the ink.

The controller 130 displays a C_Empty screen on the display 17 in response to the high-level signal from the liquid level sensor 155 after the waiting time Tw elapses so as to notify the user of the fact that the position of the liquid level of the liquid chamber 171 of the tank 160 is less than the predetermined position P.

The liquid level sensor 155 outputs a signal in correspondence with the position of the liquid level of the liquid chamber 171 of the tank 160, so that it is possible to determine that the position of the liquid level of the liquid chamber 171 is less than the predetermined position P.

First Modification

In the above-described embodiment, in the image recording process S29, the waiting time Tw is calculated in correspondence with the ink amount ΔV per unit time of the ink discharged through the head 21 in response to the recording instruction. Alternatively, the waiting time Tw may be calculated based on temperature information received from a temperature sensor.

The printer 10 includes a temperature sensor, and the controller 130 receives the temperature information from the temperature sensor. The temperature sensor measures a temperature of environments which are set in the printer 10, and outputs the temperature corresponding to the measured temperature. If the temperature of the environment where the printer 10 is installed is lowered, the temperature of the ink is lowered and a viscosity is increased. As a result, a flowing speed of the ink with respect to the liquid chamber 171 of the tank 160 is lowered by the liquid chamber 210 of the cartridge 200. In other words, a flow rate Qc becomes small, and a time taken until the position of the liquid level of the liquid chamber 171 temporarily descends and ascends again is increased. Therefore, the waiting time Tw corresponding to the time can be set.

Second Modification

In the above-described embodiment, in the image recording process S29, the waiting time Tw is calculated in accordance with the ink amount ΔV per unit time of the ink discharged through the head 21 in response to the recording instruction. Alternatively, the waiting time Tw may be calculated based on the flow rate Qc.

The flow rate Qc indicates the amount of the ink discharged from the liquid chamber 210 to the liquid chamber 171 during a period At through internal space of the needle 181 and the ink valve chamber 213. The flow rate Qc is calculated from the following expression.

$$Qc=(Hc-Hs)\times g\times \rho/(Rc+Rs+Rn)$$

"Hc" represents a height of the liquid level from a reference position in the liquid chamber 210 of the cartridge 200. "Hs" represents a height of the liquid level from the reference position in the liquid chamber 171 of the tank 160. The reference position is an arbitrary position and, for example, may be the predetermined position P. The flow rate Qc is increased as a difference between the heights Hc and Hs (that is, head difference) in increased, and decreased as the head difference is decreased. The height Hc is calculated in a relation with the ink amount Vc. In other words, the height He is calculated based on a function Fc which is predetermined using the ink amount Vc and the height He as parameters at the time of designing in a case where a horizontal cross-sectional area Dc of the liquid chamber 210 of the cartridge 200 is changed with respect to the up and down direction 7. In a case where the horizontal cross-sectional area Dc in the up and down direction 7 is constant, the function Fc=Vc/Dc.

The height Hs is calculated based on a function Fs which is predetermined using the ink amount Vs and the height Hs as parameters at the time of designing in a case where the horizontal cross-sectional area Ds of the liquid chamber 171 of the tank 160 is changed with respect to the up and down direction 7. In a case where the horizontal cross-sectional area Ds in the up and down direction 7 is constant, the function Fs=Vs/Ds.

Then, the flow rate Qc is calculated using a numerator obtained by multiplying an ink viscosity ρ and a gravitational acceleration g to a difference between the heights He and Hs, and a denominator obtained by summing the passage resistances Rc, Rs, and Rn. The passage resistance Rc represents a magnitude of the resistance of the air passing through the air valve chamber 214. The passage resistance Rs represents a magnitude of the resistance of the air passing through the air communication chamber 175. The passage resistance Rn represents a magnitude of the resistance of the ink passing through the connected ink valve chamber 213 and the internal space of the needle 181. In a case where a semipermeable membrane is provided in a flow path from the air communication port 221 to the through-hole 218, and a flow path from the air communication port 177 to the through-hole 176, the passage resistances Rc and Rs represent a resistance when the air passes through the semipermeable membrane.

When the ink moves from the liquid chamber 210 to the liquid chamber 171, the liquid chamber 210 is temporarily depressed from the atmospheric pressure, and the liquid chamber 171 is temporarily pressured from the atmospheric pressure. A difference between the pressure in the liquid chamber 210 and the atmospheric pressure is released by the air flowing into the liquid chamber 210 through the air valve chamber 214. In a state where the ink is not discharged from the liquid chamber 171 to the head 21, the difference between the pressure in the liquid chamber 171 and the atmospheric pressure is released by discharging the air from the liquid chamber 171 through the air communication chamber 175.

Then, such a pressure difference hinders the movement of the ink from the liquid chamber 210 to the liquid chamber 171. In other words, the flow rate Qc is reduced as the passage resistance Rc is increased, and increased as the passage resistance Rc is reduced. In a state where the ink is not discharged from the liquid chamber 171 to the head 21, the flow rate Qc is reduced as the passage resistance Rs is increased, and increased as the passage resistance Rs is reduced. The flow rate Qc is reduced as the ink valve chamber 213 where the passage resistance Rn of the ink actually passes through and the internal space of the needle 181 is increased, and increased as the passage resistance Rn is reduced.

The flow rate Qc is increased as a difference (head difference) between the position of the liquid level of the liquid chamber 210 of the cartridge 200 and the position of the liquid level of the liquid chamber 171 of the tank 160 is increased. Therefore, the time until the position of the liquid level of the liquid chamber 171 temporarily descends and ascends again is lengthened. The waiting time Tw corresponding to the time is set by calculating the waiting time Tw based on the flow rate Qc.

Third Modification

In the above-described embodiment, the description has been described such that the controller 130 is determines whether the signal received from the liquid level sensor 155 is the high-level signal in S28. Alternatively, the controller 130 may determine whether the total amount Vt is less than the threshold after S27, and execute S29 when the total amount Vt is less than a threshold. For example, the threshold corresponds to a volume less than the predetermined position P in the liquid chamber 171 of the tank 160. If the total amount Vt is equal to or more than the threshold, the liquid level of the liquid chamber 171 is the predetermined position P or more, so that the signal received from the liquid level sensor 155 is not changed from the low-level signal to the high-level signal. Accordingly, the controller 130 does not execute S29, and executes S20, and then executes the counting process.

Other Modifications

In the above-described embodiment, the controller 130 calculates the waiting time Tw when determining that the signal received from the liquid level sensor 155 immediately before S27 is the low-level signal and the signal received from the liquid level sensor 155 immediately after S27 is the high-level signal, but, without executing the above step, may always calculate the waiting time Tw after the image recording.

In the above-described embodiment, the cartridge 200 is shown as an example of the main tank, but instead of the cartridge 200, a tank fixed to the housing 14 of the printer 10 may be realized as the main tank. In addition, the air communication chamber 175 is not necessarily provided in the tank 160.

In the above-described embodiment, the discharge of ink through the head 21 is described as image recording on a sheet. However, the discharge of ink through the head 21 may be so-called purge in which the ink is forcibly discharged from the nozzle 29 of the head 21.

In addition, the liquid level sensor 155 is configured to detect whether the detection target portion 194 of the actuator 190 is located at the detection position, but the configuration of the liquid level sensor 155 is not particularly limited. For example, the liquid level sensor 155 may be a sensor for optically detecting the liquid level of the ink in the liquid chamber 171 using a prism having a different reflectance depending on whether the ink is in contact with the rear wall 164 of the liquid chamber 171, or may be configured to detect the liquid level of the ink in the liquid chamber 171 using electrodes. In addition, the liquid level sensor 155 may be implemented not to detect the liquid level of the liquid chamber 171 but to detect the liquid level of the liquid chamber 210.

Furthermore, in the embodiment described above, the ink is an example of liquid. However, the liquid, for example, may be pretreatment liquid discharged to a paper and the like prior to ink at the time of image recording, or may be water for cleaning the head 21.

According to the present disclosure, at least the following modes are provided.

(1) A liquid discharge device may include: a main including a first liquid chamber in which a liquid is stored, a first flow path in which one end thereof communicates with the first liquid chamber and the other end communicates with the outside; a sub tank including a second liquid chamber; a second flow path through which the first liquid chamber and the second liquid chamber communicate with each other; a third flow path in which one end thereof located below the second flow path communicates with the second liquid chamber; a head that communicates with the other end of the third flow path; a liquid level sensor; and a controller. The controller is configured to: accept a discharge instruction to discharge a liquid through the head and discharge the liquid from the head; obtain a waiting time based on information on the discharge of the liquid after the discharge of the liquid through the head is completed; and determine a signal received from the liquid level sensor after the waiting time elapses from when the discharge of the liquid through the head is completed.

According to the above configuration, even when the position of the liquid level temporarily descends and then ascends due to the discharge of the liquid through the head, the signal received from the liquid level sensor is determined after the waiting time elapses, and thus it is possible to prevent the controller from determining the signal of the liquid level signal due to the position of the liquid level descended temporarily.

(2) Preferably, the information on the discharge of the liquid is a liquid amount per unit time discharged through the head according to the discharge instruction.

As the amount of liquid per unit time discharged through the head increases, the time until the position of the liquid level in the first liquid chamber or the second liquid chamber ascends after temporarily descending becomes longer, whereby it is possible to set the waiting time corresponding to such a time.

(3) Preferably, the liquid discharge device further includes a temperature sensor, and the information on the discharge of the liquid is temperature information received from the temperature sensor at the time of discharging the liquid through the head.

When the temperature of the environment, in which the device is installed, is low, the temperature of the liquid is also lowered and the viscosity rises. As a result, the flow speed of the liquid between the first liquid chamber and the second liquid chamber becomes slow, and the time until the position of the liquid level in the first liquid chamber or the second liquid chamber ascends after temporarily descending becomes longer, whereby it is possible to set the waiting time corresponding to such a time.

(4) Preferably, the liquid discharge device further includes a fourth flow path in which one end thereof communicates with the second liquid chamber and the other end communicates with the outside. The controller is configured to calculate, after the discharge of the liquid through the head is completed, a flow rat Qc of a liquid flowing out between the first liquid chamber and the second liquid chamber during a period At, based on at least a height Hc from a reference position to a liquid level of the first liquid chamber and a height Hs from the reference position to the liquid level of the second liquid chamber, and the information on the discharge of the liquid is the flow rate Qc.

As the difference (water head difference) between the position of the liquid level in the first liquid chamber and the position of the liquid level in the second liquid chamber is larger, the time until the position of the liquid level in the first liquid chamber or the second liquid chamber ascends after temporarily descending becomes longer, whereby it is possible to set the waiting time corresponding to such a time.

(5) Preferably, the controller is configured to: receive a first signal from the liquid level sensor when a position of the liquid level in the first liquid chamber or the second liquid chamber is lower than a predetermined position; and obtain the waiting time, after the discharge of the liquid through the head is completed, on a condition that the first signal is received from the liquid level sensor.

When the first signal is not received from the liquid level sensor after the discharge of the liquid through the head is completed, even when the position of the liquid level in the first liquid chamber or the second liquid chamber ascends after a lapse of time, there is no change in the signal received from the liquid level sensor. With the above configuration, it is possible to determine the signal received from the liquid level sensor without obtaining the waiting time in such a case.

(6) Preferably, the controller is configured to: receive a second signal from the liquid level sensor when a position of the liquid level in the first liquid chamber or the second liquid chamber is equal to or higher than a predetermined position; and obtain the waiting time, upon starting the discharge of the liquid through the head, on a condition that the second signal is received from the liquid level sensor.

When the second signal is not received from the liquid level sensor at the time of starting the discharge of the liquid through the head, the signal received from the liquid level sensor does not change from the second signal after the discharge of the liquid through the head is completed. With the above configuration, it is possible to determine the signal received from the liquid level sensor without obtaining the waiting time in such a case.

(7) Preferably, the liquid discharge device further includes a memory that stores a total liquid amount Vt stored in both the first liquid chamber and the second liquid chamber. The controller is configured to: update a count value with a value equivalent to an amount of the liquid instructed to be discharged by the discharge instruction; read the total liquid amount Vt from the memory, and calculate the liquid amount Vt by subtracting the count value; and obtain the waiting time, the discharge of the liquid through the head is completed, on a condition that the total liquid amount Vt is less than a threshold.

When the total amount Vt is sufficiently larger than the amount of change in the signal received from the liquid level sensor after the discharge of the liquid through the head is completed, there is no change in the signal received from the liquid level sensor. With the above configuration, it is possible to determine the signal received from the liquid level sensor without obtaining the waiting time in such a case.

(8) Preferably, the liquid discharge device further includes a memory, and the controller is configured to: cause the memory to store the waiting time when accepting a next discharge instruction before the waiting time elapsed after the discharge of the liquid through the head is completed, and start to discharge a liquid through the head before the waiting time elapses; and determine the signal received from the liquid level sensor when a time obtained by adding the waiting time stored in the memory to the waiting time obtained after the next discharge instruction elapses from when the discharge of the liquid from the head according to the next discharge instruction is completed.

When the discharge instruction is accepted during the waiting time, the discharge of the liquid is started before the waiting time elapse, and thus the user does not need to wait for the time until the discharge of the ink is started from the next discharge instruction. Then, when the discharge of the ink is completed by the next discharge instruction, the determination the signal received from the liquid level sensor is waited until the waiting time obtained by adding the previous waiting time stored in the memory to the waiting time requested at the next time elapses, and thus the waiting time until the position of the liquid level ascends again can be set in addition to the descending amount of the position of the liquid level of the liquid chamber generated by the previous discharge of the ink.

(9) Preferably, the liquid discharge device further includes a notification device, and the controller is configured to: receive a first signal from the liquid level sensor when a position of the liquid level in the first liquid chamber or the second liquid chamber is lower than a predetermined position; and operate the notification device when receiving the first signal from the liquid level sensor after the waiting time elapses.

According to the above configuration, it is possible to notify the user that the position of the liquid level in the first liquid chamber or the second liquid chamber becomes lower than the predetermined position.

(10) Preferably, the liquid level sensor outputs a signal in response to the position of the liquid level in the second liquid chamber.

According to the above configuration, it is possible to accurately determine that the position of the liquid level in the second liquid chamber becomes lower than the predetermined position.

(11) Preferably, the main tank is a cartridge type detachable from an installation case.

According to the present disclosure, it is possible to accurately determine the signal output from the liquid level sensor for detecting the liquid level of the liquid in the first liquid chamber or the second liquid chamber.

What is claimed is:

1. A liquid discharge device comprising:

a main tank comprising:

a first liquid chamber storing a liquid; and a first flow path, one end of the first flow path communicated with the first liquid chamber, the other end of the first flow path communicated with an atmosphere;

a sub tank comprising a second liquid chamber;

a second flow path through which the first liquid chamber and the second liquid chamber communicate with each other;

a third flow path, one end of the third flow path being located below the second flow path communicated with the second liquid chamber;

a head communicated with the other end of the third flow path;

a liquid level sensor; and a controller configured to:

receive a discharge instruction for discharging a liquid through the head;

control the head based on the discharge instruction to discharge the liquid from the head;

determine a waiting time based on information on the discharge of the liquid after the discharge of the liquid through the head is completed; and determine a signal received from the liquid level sensor when the waiting time elapses from a time point at which the discharge of the liquid through the head is completed.

2. The liquid discharge device according to claim 1, wherein the information on the discharge of the liquid is a liquid amount per unit time discharged through the head according to the discharge instruction.

3. The liquid discharge device according to claim 1, further comprising:

a temperature sensor, wherein the information on the discharge of the liquid is temperature information received from the temperature sensor at the time of discharging the liquid through the head.

4. The liquid discharge device according to claim 1, further comprising:

a fourth flow path, one end of the fourth flow path communicated with the second liquid chamber, the other end of the fourth flow path communicated with the atmosphere, wherein the controller is configured to determine, after the discharge of the liquid through the head is completed, a flow rate Qc of a liquid flowing out between the first liquid chamber and the second liquid chamber during a period At, based on at least a height Hc from a reference position to a liquid level of the first liquid chamber and a height Hs from the reference position to the liquid level of the second liquid chamber, and wherein the information on the discharge of the liquid is the flow rate Qc.

5. The liquid discharge device according to claim 1, wherein the controller is configured to:

receive a first signal from the liquid level sensor, the first signal indicating a position of the liquid level in the first liquid chamber or the second liquid chamber is lower than a predetermined position; and on a condition that the first signal is received from the liquid level sensor, determine the waiting time, after the discharge of the liquid through the head is completed.

6. The liquid discharge device according to claim 1, wherein the controller is configured to:

receive a second signal from the liquid level sensor, the second signal indicating a position of the liquid level in the first liquid chamber or the second liquid chamber is equal to or higher than a predetermined position; and on a condition that the second signal is received from the liquid level sensor, determine the waiting time, upon starting the discharge of the liquid through the head.

7. The liquid discharge device according to claim 1, further comprising:

a memory storing a total liquid amount Vt stored in both the first liquid chamber and the second liquid chamber, wherein the controller is configured to:

update a count value with a value equivalent to an amount of the liquid instructed to be discharged by the discharge instruction;

read the total liquid amount Vt from the memory; and update the total liquid amount Vt by subtracting the count value from the total liquid amount Vt read from the memory; and determine the waiting time, on a condition that the total liquid amount Vt is less than a threshold after the discharge of the liquid through the head is completed.

8. The liquid discharge device according to claim 1, further comprising:

a memory, wherein the controller is configured to:

store, in the memory, the waiting time in a case where a next discharge instruction is received before the waiting time elapsed after the discharge of the liquid through the head is completed, and start to discharge a liquid through the head before the waiting time elapses; and determine the signal received from the liquid level sensor in a case where a time obtained by adding the waiting time stored in the memory to the waiting time calculated after the next discharge instruction elapses from when the discharge of the liquid from the head according to the next discharge instruction is completed.

9. The liquid discharge device according to claim 1, further comprising:

a notification device, wherein the controller is configured to:

receive a first signal from the liquid level sensor, the first signal indicating a position of the liquid level in the first liquid chamber or the second liquid chamber is lower than a predetermined position; and when the waiting time elapses, control the notification device to activate in a case where the first signal from the liquid level sensor is received.

10. The liquid discharge device according to claim 1, wherein the liquid level sensor outputs a signal indicating the position of the liquid level in the second liquid chamber.

11. The liquid discharge device according to claim 1, wherein the main tank is a cartridge that is detachable from an installation case.

* * * * *